US011466875B2

(12) United States Patent
Weston

(10) Patent No.: US 11,466,875 B2
(45) Date of Patent: Oct. 11, 2022

(54) SINGLE PRIMARY LOOP, DUAL SECONDARY LOOP HYDRONIC HVAC SYSTEM AND METHODS OF OPERATION

(71) Applicant: Jeffrey A. Weston, Bellingham, WA (US)

(72) Inventor: Jeffrey A. Weston, Bellingham, WA (US)

(73) Assignee: Weston IP, LLC, Bellingham, WA (US)

( * ) Notice: Subject to any disclaimer, the term of this patent is extended or adjusted under 35 U.S.C. 154(b) by 0 days.

(21) Appl. No.: 17/309,944

(22) PCT Filed: Apr. 6, 2020

(86) PCT No.: PCT/IB2020/000298
§ 371 (c)(1),
(2) Date: Jul. 1, 2021

(87) PCT Pub. No.: WO2020/183244
PCT Pub. Date: Sep. 17, 2020

(65) Prior Publication Data

US 2022/0049864 A1 Feb. 17, 2022

Related U.S. Application Data

(60) Provisional application No. 62/801,792, filed on Feb. 6, 2019.

(51) Int. Cl.
*F24F 5/00* (2006.01)
*F24F 11/46* (2018.01)

(52) U.S. Cl.
CPC ..... *F24F 5/0003* (2013.01); *F24F 11/46* (2018.01); *F25B 2339/047* (2013.01)

(58) Field of Classification Search
CPC .... F24F 5/0003; F24F 11/46; F25B 2339/047
(Continued)

(56) References Cited

U.S. PATENT DOCUMENTS 5,946,926 A 9/1999 Hartman
7,028,768 B2 4/2006 Aler et al.
(Continued)

FOREIGN PATENT DOCUMENTS

WO 2020183244 A2 9/2020

OTHER PUBLICATIONS

International Search Report for International Application No. PCT/IB2020/000298, 2 pages (dated Nov. 17, 2020).

*Primary Examiner* — Steve S Tanenbaum
(74) *Attorney, Agent, or Firm* — FisherBroyles, LLP

(57) ABSTRACT

A hydronic system is provided that includes a primary fluid loop that includes a thermal source for heating or cooling a working fluid, dual secondary fluid loops that include respective thermal loads, and a decoupler. One leg of a supply tee at an output of the source places the output in fluid communication with one end of a decoupler and, beyond the decoupler, with the input of a thermal load of a first secondary fluid loop. Another leg of the supply tee places the source output in fluid communication with the input of a thermal load in a second secondary fluid loop. One leg of a return tee at an input of the source places the input in fluid communication with the other end of the decoupler and, beyond the decoupler, with the output of the thermal load of the first secondary fluid loop. Another leg of the return tee places the input of the source in fluid communication with the input of the thermal load in the second secondary fluid loop.

6 Claims, 13 Drawing Sheets

(58) Field of Classification Search
USPC ..... 62/506
See application file for complete search history.

(56) References Cited

U.S. PATENT DOCUMENTS

| | | | | |
|---|---|---|---|---|
| 2004/0227346 | A1 | 11/2004 | Jamison et al. | |
| 2013/0125565 | A1 | 5/2013 | Erpelding et al. | |
| 2015/0068228 | A1* | 3/2015 | Sedlak | F25B 30/02 62/79 |
| 2018/0224147 | A1* | 8/2018 | Cline | F25B 49/02 |

* cited by examiner

SINGLE PRIMARY LOOP, DUAL SECONDARY LOOP HYDRONIC HVAC SYSTEM AND METHODS OF OPERATION

RELATED CASES

This application claims the benefit of Provisional Patent Application Ser. No. 62/801,792, filed Feb. 6, 2019, which provisional application is incorporated herein by reference in its entirety.

BACKGROUND

Technical Field

The present disclosure is related in general to hydronic HVAC systems, and particularly to such systems that are configured to provide thermal energy management for large and/or complex facilities.

Description of the Related Art

As fuel costs increase and greenhouse gas emissions control requirements become more stringent, there is a great deal of attention and effort toward improving efficiency of heating and cooling systems, and particularly systems that are employed to provide and manage the temperature conditioning for large facilities, such as hospitals, institutional buildings, high-rise buildings, campuses, and manufacturing facilities.

Currently, hydronic systems are the most common types of HVAC systems, particularly in large facilities. A hydronic system is a closed-fluid system in which a working fluid is used as a thermal energy transfer medium. In a hydronic HVAC system, the working fluid is heated or chilled at the central plant, then piped to remote locations in a facility, where the fluid passes through heat exchangers of various types to transfer thermal energy between the working fluid and other media, such as air, for heating or cooling, water, to produce ice or hot water, or a secondary working fluid, etc.

FIGS. 1A and 1B are simplified schematic diagrams of a hydronic system 100 such as might be used in an office building for heating or cooling, for example, according to known principles, showing various configurations as examples of features that are common in such known systems. Open arrows shown in the drawings over fluid transmission lines indicate the direction of fluid flow in the respective lines of the system. Arrows positioned over the decoupler, referenced at 126, are shown pointing in both directions to indicate that fluid can flow in that line in either direction, depending upon operating conditions, as explained in more detail below. The term flow can be understood as referring to a volume of fluid passing a reference point such as a junction in a pipe, or other feature, per unit of time, as can be quantified for example in gallons or liters per minute, etc.

As shown in FIG. 1, the system 100 has a plant 102 that includes a source 104, in this example a fluid heater that provides heated fluid from an output 106 to a supply conduit 108, which is configured to place various elements of the system in fluid communication with the source 104. A thermal load 112 has an input 114 coupled to the supply conduit 108 and an output 116 coupled to a return conduit 120, which is configured to place the various elements of the system in fluid communication with an input 122 of the source 104. In this example, the thermal load 112 includes heat transfer elements, configured, for example, to extract thermal energy from the working fluid to heat air for forced-air heating in respective floors of the building, to maintain a desired ambient temperature.

Although not shown, the load 112 includes a pump that can be controlled to draw fluid from the supply conduit 108 at a rate that corresponds to a local demand for heat. Fluid that is passed to the return conduit 120 by the load 112 is carried to an input 122 of the source 104, to be reheated.

The system 100 also includes a decoupler 126 coupled, at a first decoupling tee 124, to the supply conduit 108 and the output 106 of the source 104 and, at a second decoupling tee 125, to the return conduit 120 and the input 122 of the source. This configuration is commonly known as a primary/secondary piping arrangement. The decoupler 126 is configured to permit a differential flow of fluid—meaning that the source flow and the load flow do not need to be equal—directly between the supply and return conduits 108, 120 of the system 100 in either direction (as indicated by the bi-directional arrows shown on the decoupler), in response to a flow differential between the conduits. The decoupler 126 decouples the source 104 from the load 112 so that the source and the load operate in overlapping but semi-independent loops. The source 104 can therefore produce heated fluid at a rate that is not directly limited or controlled by the rate at which the load 112 demands heated fluid, while the load can draw fluid at a self-determined rate that is not constrained by the output flow of the source. If the source 104, for example, produces more heated fluid than is required by the load 112, this produces a difference in the flow rate between the supply conduit 108 and the return conduit 120, which causes the surplus fluid flow to pass through the decoupler 126 to the return conduit 120, where it mixes with fluid returning from the various loads 112. Similarly, if the total fluid demand from the load 112 is greater than the flow supplied by the source 104, a flow difference in the opposite direction causes fluid to pass through the decoupler 126 from the return conduit 120 to the supply conduit 108, where it mixes with conditioned fluid flowing from the source toward the load 112.

Such a system is typically referred to as having a primary loop 128 and a secondary loop 130. The primary loop 128 is defined by a fluid flow path that passes through the source 104, while the secondary loop 130 is defined by a fluid flow path that passes through the load 112. It can be seen that if the decoupler 126 were not present, the primary and secondary loops 128, 130 would necessarily be identical, with the flow rate of the primary loop being exactly equal to that of the secondary loop. However, because the decoupler 126 provides an alternative path, fluid that flows in the primary loop 128 can flow through the load 112, the decoupler 126, or both, while fluid in the secondary loop 130 can likewise flow through the source 104, the decoupler 126, or both. Furthermore, the flow of the primary loop 128 and the flow of the secondary loops 130 can have different values. Because the paths of the various loops (and sub-loops, as described below) overlap significantly, and can vary depending upon operating conditions, the reference numbers indicating each of the loops point to flow arrows through which fluid of the respective referenced loop necessarily passes.

In the system 100, a flow indicator 152 is provided to monitor the direction and volume of flow in the decoupler 126.

FIG. 1A shows a single thermal source 104 and a single thermal load 112. However, systems as simple as that shown in FIG. 1A are not common. More typical hydronic systems, particularly those found in large facilities, are much more complex than the system shown in FIG. 1A. Additionally, the complexity of such systems can vary over time, often becoming more complex and convoluted as conditions in a facility change and evolve, and the HVAC system is modified to meet the new requirements. Such changes can come as a result of, for example, changes in tenancy, changes in types of operations conducted in a space, addition of new spaces, subdivision of existing spaces, etc.

FIG. 1B shows some details of the source 104 and the load 112 of the system 100, according to one example. In this example, the load 112 includes a plurality of load element 118 distributed among various load loops 110 that together define the secondary loop 130. One load loop 110*a* includes two load elements 118*a* coupled in parallel between the supply conduit 108 and the return conduit 120. Another load loop 110*b* includes a pair of load elements 118*b* coupled in series with each other, and with a supplemental heating source 119, between the supply conduit 108 and the return conduit 120. A further load loop 110*c* includes a load element 118*c* coupled in parallel with a portion of the supply conduit 108 so that fluid flow in the load loop 110*c* is returned to the supply conduit 108.

As with the load 112, the source 104 can be more complicated than suggested in FIG. 1A. For example, in FIG. 1B, the source 104 is shown as including a plurality of source elements 136 in corresponding source loops 182 that together define the primary loop 128. Multiple source elements may be used, rather than a single large source element, for any of a number of reasons, including, e.g., redundancy, space constraints, cost, controllability, changes in required capacity, etc.

Although not shown, the thermal source elements 136, and load elements 118 each can include one or more fluid pumps configured to draw fluid through the respective element according to the fluid requirements of that element or components thereof. Source and load elements of the kinds employed in HVAC systems, and the pumping systems are well known and understood in the art.

The examples of system configurations shown in FIGS. 1A and 1B are only two of a very large number of configurations that are currently in use, but they are sufficient to provide some understanding of the multitude of potential arrangements of hydronic systems.

During normal operation, the source 104 provides a flow of conditioned fluid from its output 106 to the first decoupling tee 124. Assuming a constant output temperature of fluid from the source 104, each of the load elements 118 meets a varying demand for heat by controlling a respective load pump to regulate the fluid flow passing through the corresponding sub-loop 110. If a load element 118 has an increased demand for thermal energy, the corresponding load pump is controlled to increase the draw of fluid from the supply conduit 108. If the flow from the source 104 is about equal to the total volume of fluid drawn by the load 112, all of the fluid supplied by the source will pass through the first decoupling tee 124 to the supply conduit 108 and through the respective sub-loops 110 to the return conduit 120. From the return conduit 120, the fluid passes through the second decoupling tee 125 to the source input 122.

If the total fluid demand is more or less than the supply, fluid will flow in the decoupler 126 to compensate for the difference. For example, if the total fluid demand of the load 112 exceeds the fluid output of the source 104, the difference in fluid volume is made up by fluid that passes through the decoupler 126 from the return conduit 120 to the supply conduit 108 in response to the difference in the flows produced by the collective operation of the pumps of each of the load elements 118 of the sub-loops 110, against the fluid flow produced by the source 104. The fluid passing through the decoupler 126 combines with the fluid from the source output 106 at the first decoupling tee 124 to flow into the supply conduit 108. Of course, this means that the conditioned fluid from the source is diluted by "used" fluid entering from the decoupler 126, and the temperature of the fluid in the supply line 108 is reduced before it reaches the sub-loops 110 by the addition of the bypass fluid from the decoupler 126.

In response to the reduced fluid temperature, the load elements 118 will increase the volume of fluid drawn from the supply conduit to extract sufficient thermal energy from the cooler working fluid to meet their requirements, so that the total demand increases further, which increases the volume of fluid transiting the decoupler 126, and the fluid that returns to the input 122 of the source 104 is further cooled. Essentially, the load 112 is extracting more thermal energy from the fluid than the source 104 is introducing, so, absent a change in the operating conditions, the fluid will get progressively cooler until the system reaches an equilibrium, in which the fluid temperature drops to a point where the load cannot extract more heat from the fluid than the source can provide.

SUMMARY OF THE DISCLOSURE

According to an embodiment, a thermal management system is provided, including a thermal source, first and second thermal loads, and a decoupler. A first terminal of the decoupler is coupled in a first three-way coupling with an output of the source and a input of the first load. A second terminal of the decoupler is coupled in a second three-way coupling with an input of the source and an output of the first load. The output of the source is coupled in a third three-way coupling with an input of the second load and the first terminal of the decoupler, via the first three-way coupling, and the input of the source is coupled in a fourth three-way coupling with an output of the second load and the second terminal of the decoupler, via the second three-way coupling.

According to an embodiment, the decoupler is unregulated, such that fluid can pass in either direction, according to differential fluid flows within the system.

According to an embodiment, the source comprises a plurality of source elements sharing a common input and a common output.

According to an embodiment, one or both of the first and second thermal loads comprises a plurality of load elements.

According to an embodiment, the first and second thermal loads, the decoupler, and the thermal source are components of a first hydronic system. The thermal source includes a component of a heat pump, and is configured to transfer thermal energy between a working fluid of the first hydronic system and a refrigerant of the heat pump. The thermal management system further includes a second hydronic system that itself includes a thermal source configured to transfer thermal energy between a working fluid of the second hydronic system and the refrigerant of the heat pump.

According to an embodiment, a hydronic system is provided that comprises first and second thermal loads, a decoupler, and a thermal source. The system further includes first, second, third, and fourth fluid tees. The first fluid tee has a first terminal coupled to a first terminal of the decoupler, a second terminal coupled to an input of the second load, and a third terminal coupled to a terminal of the third tee. The second fluid tee has a first terminal coupled to a second terminal of the decoupler, a second terminal coupled to an output the second load, and a third terminal coupled to a terminal of the fourth tee. The third fluid tee has a first terminal coupled to an output of the source, a second terminal coupled to the third terminal of the first fluid tee, and a third terminal operatively coupled to an input of the first load. Finally, the fourth fluid tee has a first terminal coupled to an input of the source, a second terminal coupled to the third terminal of the second fluid tee, and a third terminal operatively coupled to an output of the first load.

According to an embodiment, the thermal source is one of a plurality of source elements. The third tee is one of a first plurality of tees coupled in series between the first terminal of the decoupler and the input of the first load, each having a respective terminal coupled to the output of a corresponding one of the plurality of source elements. The fourth tee is one of a second plurality of tees coupled in series between the second terminal of the decoupler and the output of the first load, each having a respective terminal coupled to the input of a corresponding one of the plurality of source elements.

According to an embodiment, a thermal management system is provided, including first and second hydronic systems. The first and second hydronic systems each include first and second thermal loads, a decoupler, and a thermal source, together with first, second, third, and fourth fluid tees arranged substantially as described with respect to the hydronic system of the previous embodiment. The thermal management system further includes a heat pump, of which the thermal sources of the first and second hydronic systems each form a part. The thermal source of the first hydronic system includes an evaporator of the heat pump, configured to extract thermal energy from a working fluid of the first hydronic system, while the thermal source of the second hydronic system includes a condenser configured to impart the thermal energy extracted by the evaporator to a working fluid of the second hydronic system.

According to an embodiment, a hydronic system is provided, which includes first, second, third, and fourth fluid tees with respective first, second, and third terminals. The first terminals of the first and third fluid tees are coupled to each other, and the first terminals of the second and fourth fluid tees are coupled to each other. A thermal source has a source output coupled to the second terminal of the first fluid tee and a source input coupled to the second terminal of the second fluid tee. A decoupler has a first terminal coupled to the second terminal of the third fluid tee and a second terminal coupled to the second terminal of the fourth fluid tee. A first thermal load has a first load input coupled to the third terminal of the first fluid tee and a first load output coupled to the third terminal of the second fluid tee. Finally, a second thermal load has a second load input coupled to the third terminal of the third fluid tee and a second load output coupled to the third terminal of the fourth fluid tee.

According to an embodiment, the thermal source is one of a plurality of thermal sources, each having a respective source input and source output. The first fluid tee is one of a first plurality of fluid tees, which are coupled in series with a second terminal of each of the first plurality of fluid tees being coupled to the source output of a respective one of the plurality of thermal sources, a first one of the first plurality of fluid tees having a third terminal coupled to the first load input, and a last one of the first plurality of fluid tees having a first terminal coupled to the first terminal of third fluid tee. The second fluid tee is one of a second plurality of fluid tees, which are coupled in series, with a second terminal of each of the second plurality of fluid tees being coupled to the source input of a respective one of the plurality of thermal sources, a first one of the second plurality of fluid tees having a third terminal coupled to the first load output, and a last one of the first plurality of fluid tees having a first terminal coupled to the first terminal of the fourth fluid tee.

According to an embodiment, each of the plurality of thermal source elements has a respective temperature set point, and the source elements are arranged such that one of the plurality of source elements configured to produce the highest-grade fluid, from among the plurality of source elements, is positioned closest to the decoupler, and one of the plurality of source elements configured to produce the lowest-grade fluid, from among the plurality of source elements, is positioned closest to the second thermal load. The thermal loads are selected such that the first thermal load requires a grade of fluid that is higher than that required by the second thermal load.

According to an embodiment, a hydronic system is provided, which includes supply side and return side conduits. A source has an output coupled to the supply side conduit and an input coupled to the return side conduit; a decoupler conduit has a first end coupled to the supply side conduit and a second end coupled to the return side conduit, and is configured to allow bi-directional flow between the supply side and return side conduits. A plurality of loads is provided, each load having an input coupled to the supply side conduit and an output coupled to the return side conduit. The plurality of loads includes a preferred load and a non-preferred load. The preferred load is coupled to the supply side and return side conduits on a same side of the decoupler conduit as the source, and the non-preferred load is coupled to the supply side and return side conduits on a side of the decoupler conduit opposite the source.

According to an embodiment, the source is one of a plurality of source elements, each having an output coupled to the supply side conduit and an input coupled to the return side conduit. The preferred load is coupled to the supply side and return side conduits on a side of the plurality of source elements opposite the decoupler conduit.

According to an embodiment, each of the plurality of source elements has a respective temperature set point, and the plurality of source elements is arranged such that one of the plurality of source elements that is configured to produce the highest-grade fluid, from among the plurality of source elements, is positioned closest to the decoupler conduit.

According to an embodiment, the non-preferred load requires a grade of fluid that is higher than that required by the preferred load.

According to an embodiment, each of the plurality of source elements has a respective temperature set point, and the plurality of source elements is arranged such that a source element configured to produce the lowest-grade fluid, from among the plurality of source elements, is positioned closest to the preferred load.

DETAILED DESCRIPTION

Figure 1A:
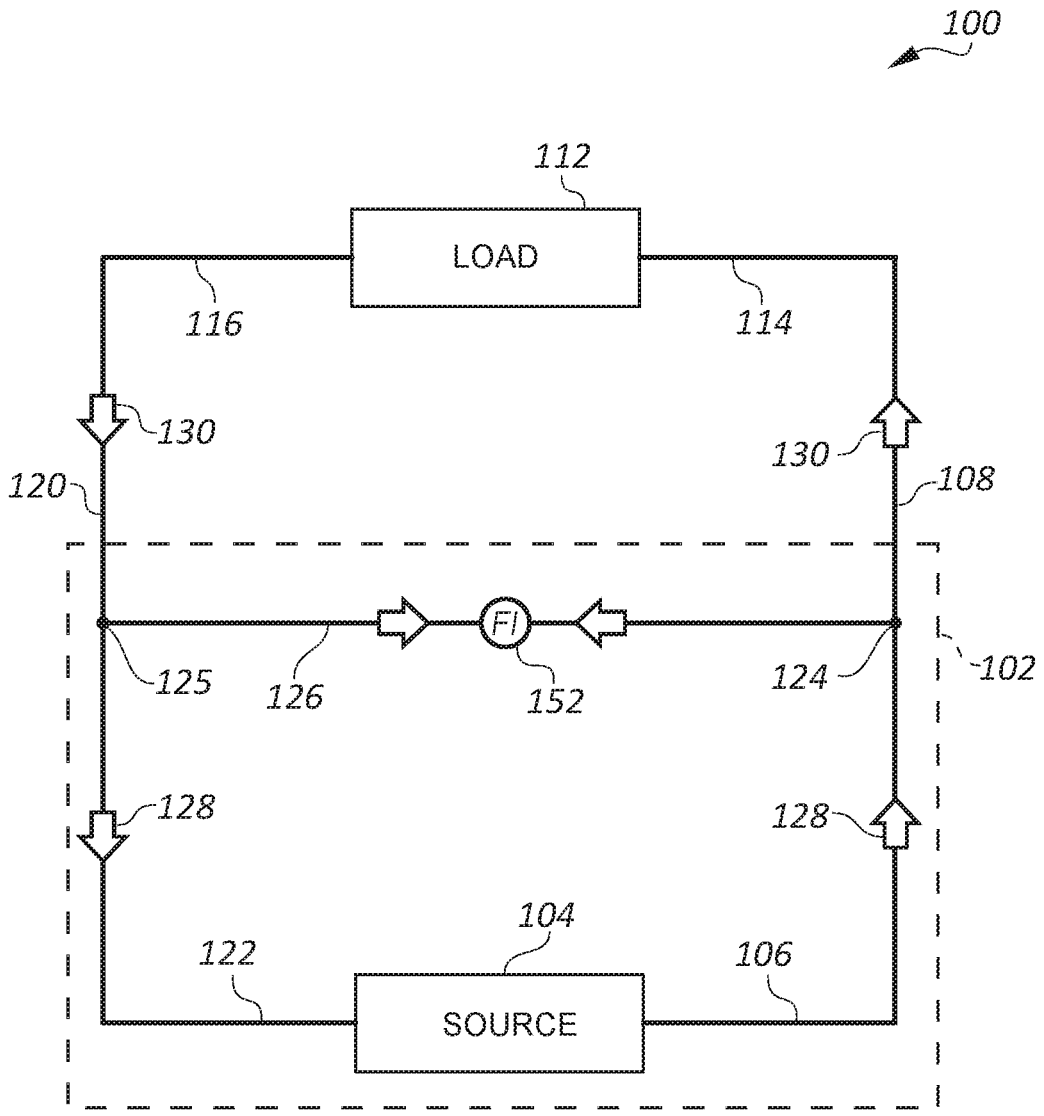
FIG. 1A Prior Art
FIGS. 1A and 1B are simplified schematic diagrams of a hydronic system such as might be used in a building for HVAC, for example, according to known principles, and showing various configurations as examples of features that are common in such known systems.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

In referring to elements of embodiments that are described below with reference to the drawings, terms such as upper and lower, and related terms, are used to distinguish otherwise similar elements according to their relative positions in the drawings. This is for convenience and clarity but is not intended to imply any absolute or relative characteristics or positions of physical embodiments that operate under the principles disclosed herein. Even where the terms are used with reference to elements of such physical embodiments, there is no implied limitation, nor are the claims limited by the use of these terms in the specification.

In many of the drawings, elements are designated with a reference number followed by a letter, e.g., 182*a*, or 182*b*. In such cases, the letter designation is used where it may be useful in the corresponding description to differentiate between or to refer to specific ones of a number of otherwise similar or identical elements. Where the description omits the letter from a reference, and refers to such elements by number only, this can be understood as a general reference to any or all of the elements identified by that reference number, unless other distinguishing language is used.

Definitions

A working fluid is a gas or liquid that is used to transfer thermal energy into or out of a region of interest. Typically, a working fluid is transmitted in a closed loop, so that the fluid is retained in the system for reuse. In the embodiments described below, the working fluid is assumed to be water, but this is not essential. Other fluids that are commonly used in hydronic systems include glycol, but except where a working fluid is explicitly identified, the claims are not limited to any particular fluid.

HVAC is used to refer generically to thermal energy management systems described herein. Such systems are not limited to heating, ventilation, and air conditioning systems as suggested by the acronym. Embodiments are contemplated in which hydronic systems are also configured to provide thermal energy management and control for various other applications, such as might be found in kitchens, laboratories, gymnasiums, industrial facilities, etc., and that might require e.g., hot and/or cold water, steam, food or specimen refrigeration, surface temperature control, etc. Accordingly, where used, the term HVAC is to be construed broadly so as to include such additional applications.

As used herein, a tee is a three-way fluid junction with three branches, or terminals, through which fluid can flow from any of the three branches to any one or both of the other branches. It is not necessary that a tee have the same physical arrangement or orientation shown in the drawings. Instead, it can be any coupling whereby a flow can diverge into at least two flows and/or two flows can merge into one flow.

The term source is used in the specification and claims to refer to a thermal transfer element that operates to condition a working fluid by transferring thermal energy to or from the working fluid for the purpose of modifying a temperature of the fluid, while the term load is used to refer to a thermal transfer element that operates to modify the temperature, or at least a thermal energy content of a thermal demand element, by transferring thermal energy between a working fluid and the thermal demand element. For example, a heat source operates primarily to impart thermal energy to a working fluid, and can be an element such as a boiler or the condenser of a heat pump, etc., configured to heat the working fluid that is circulated therethrough. Likewise a cooling source operates primarily to extract thermal energy from a working fluid, and can be an element such as the evaporator of a heat pump configured to chill the working fluid, or a cooling tower configured to transfer heat from the working fluid to exterior air, etc. Conversely, a heat load operates to transfer thermal energy from a working fluid to a thermal demand element, and can be, e.g., an air handling unit (AHU) with a coil through which the working fluid passes and across which air, i.e., the thermal demand element, is circulated, to warm ambient air of a work space, or the evaporator of a secondary heat pump configured as a component of an AHU or a domestic water heater, to transfer thermal energy from a working fluid to a thermal demand element, in this case ambient air or water in a tank, etc. Finally, a cooling load operates to transfer thermal energy from a thermal demand element to a working fluid, and can be, for example, the condenser of a heat pump that is configured to transfer heat from the ambient air of a workspace, or from a refrigerator or freezer, etc., to the working fluid.

It should be noted that a heat source and a cooling load both increase the temperature of the working fluid, and, similarly, a heat load and a cooling source both decrease the temperature of the working fluid. Ultimately, the distinction depends upon the system in which they are used. A heating system is configured to provide heat in a facility, such as for environmental heating, hot water, etc., and includes heat sources and heat loads, while a cooling system is configured to "provide" cooling—i.e., remove thermal energy—in a facility, such as for air conditioning, refrigeration, etc., and includes cooling sources and cooling loads. It will be recognized that there are many more types and configurations of heat transfer elements that might be used with an HVAC system than can be described here. Nevertheless, the examples provided will suffice for the purposes of the present disclosure, inasmuch as most of those elements are known or discoverable, and adaptable for the disclosed purposes by a person having ordinary skill in the art.

Current Technology and Associated Deficiencies

Typically, facilities that use hydronic systems have requirements for both heating and cooling. Thus, it is common for the HVAC plants of such facilities to include both heating and cooling systems. The central plant might include a boiler plant to heat the fluid in the primary loop of a heating system, and a chiller plant to cool the fluid in the primary loop of a cooling system. However, more modern systems commonly employ heat pumps, or heat reclaim chillers, to provide both the heated and cooled fluid. Heat pumps are generally more efficient in HVAC systems because they do not generate heat by conversion from another form of energy, such as electricity, through resistive heating, or fossil fuels via combustion. Instead, a heat pump extracts thermal energy from a lower temperature first medium on the evaporator side of the heat pump and transfers the energy to the condenser side, where it is transferred to a higher temperature second medium. Thus, apart from heat produced by the compressor, no thermal energy is generated by the system. Heat extracted while chilling a first working fluid for a cooling system can be used to heat a second working fluid for a heating system. To do this, a heat pump operates simultaneously as a heat source of the heating system and as a cooling source of the cooling system, transferring thermal energy from the working fluid of the chiller system to the working fluid of the heating system. An example of an embodiment with such a configuration is described below with reference to FIGS. 6 and 7.

Broadly speaking, the layouts of a heating system and a cooling system are very similar. The diagram of the heating system 100 described above could just as easily have been described as a cooling system in which the source 104 is a cooling source rather than a heating source, and the loads 112 are cooling loads rather than heating loads. In fact, the embodiments disclosed below are described as heating systems primarily because for most people it is simpler to visualize the transmission of thermal energy (as heated fluid) in a system rather than the transmission of a relative lack of thermal energy (as cooled fluid). Nevertheless, the principles described herein with reference to a heating system can be applied with equal effectiveness to a cooling system, simply by substituting cooling sources and cooling loads for the heat sources and heat loads described. Furthermore, except where explicitly defined in the claims, the claims are not limited specifically to either heating systems or cooling systems.

Depending upon the physical characteristics of a facility, the local climate and weather, and the time of year, the heating and cooling demands of a facility are generally not perfectly balanced such that waste heat from a cooling system is exactly equal to the thermal energy demand of a heating system and vice-versa. Instead, facilities typically require supplemental heating in winter and cooling in summer.

As noted, heat pumps can provide significant improvements in operating efficiency of an HVAC plant, as compared to traditional systems. However, the efficiency of a heat pump varies significantly depending upon the operating conditions. An important factor in the overall efficiency of a heat pump is the temperature of the conditioned fluid as it leaves the device, either from the evaporator or from the condenser. For example, in a heat pump operating as a heat source so as to heat a working fluid in a hydronic system, a difference of a few degrees in a temperature set point of the fluid exiting the heat pump condenser can have a very significant impact on the efficiency of the device—set point refers to a fixed output temperature of a device such as a fluid heater or cooler. So, for example, reducing the set point of a heat-pump based heat source from 80° to 78° (F.) can produce a disproportionate improvement in the efficiency of the heat pump. Likewise, by raising the set point of a heat pump working as a chiller from 50° to 52°, its efficiency can again be significantly improved.

In the HVAC field, fluid of a more extreme temperature is sometimes referred to as high-grade fluid or high-quality fluid, as compared to fluid that is closer to ambient temperature, which is referred to as being low grade or low quality. In other words, in a heating system, high-grade fluid has a higher temperature than low-grade fluid, while in a cooling system, high-grade fluid is colder than low-grade fluid. To transmit a given amount of energy, it is typically more efficient to produce a larger volume of a relatively low-grade fluid than a smaller volume of a relatively high-grade fluid.

Another—albeit less significant—factor in system efficiency is the fluid temperature entering the device. For example, in a heat pump operating to heat a working fluid, it is more efficient to heat colder fluid, even though more thermal energy is transferred to bring the colder fluid up to the set point. The transfer of thermal energy between the refrigerant of a heat pump and the working fluid is a function of both the temperature difference between the two fluids and their time in contact with the refrigerant. For example, if the incoming fluid is colder, it will require longer time in contact with the hot refrigerant to reach the set point temperature than if the fluid enters at a higher temperature. However, in this case, the controlling element is the fluid pump that moves fluid through the device. The dimensions of the heat exchanger are fixed, which means that to increase time in contact, the flow rate must be reduced, i.e., the fluid pump must be slowed. Of course, slowing the pump reduces the energy consumption of the pump, so that less electrical energy is required to heat colder fluid to the same temperature.

Figure 1B:
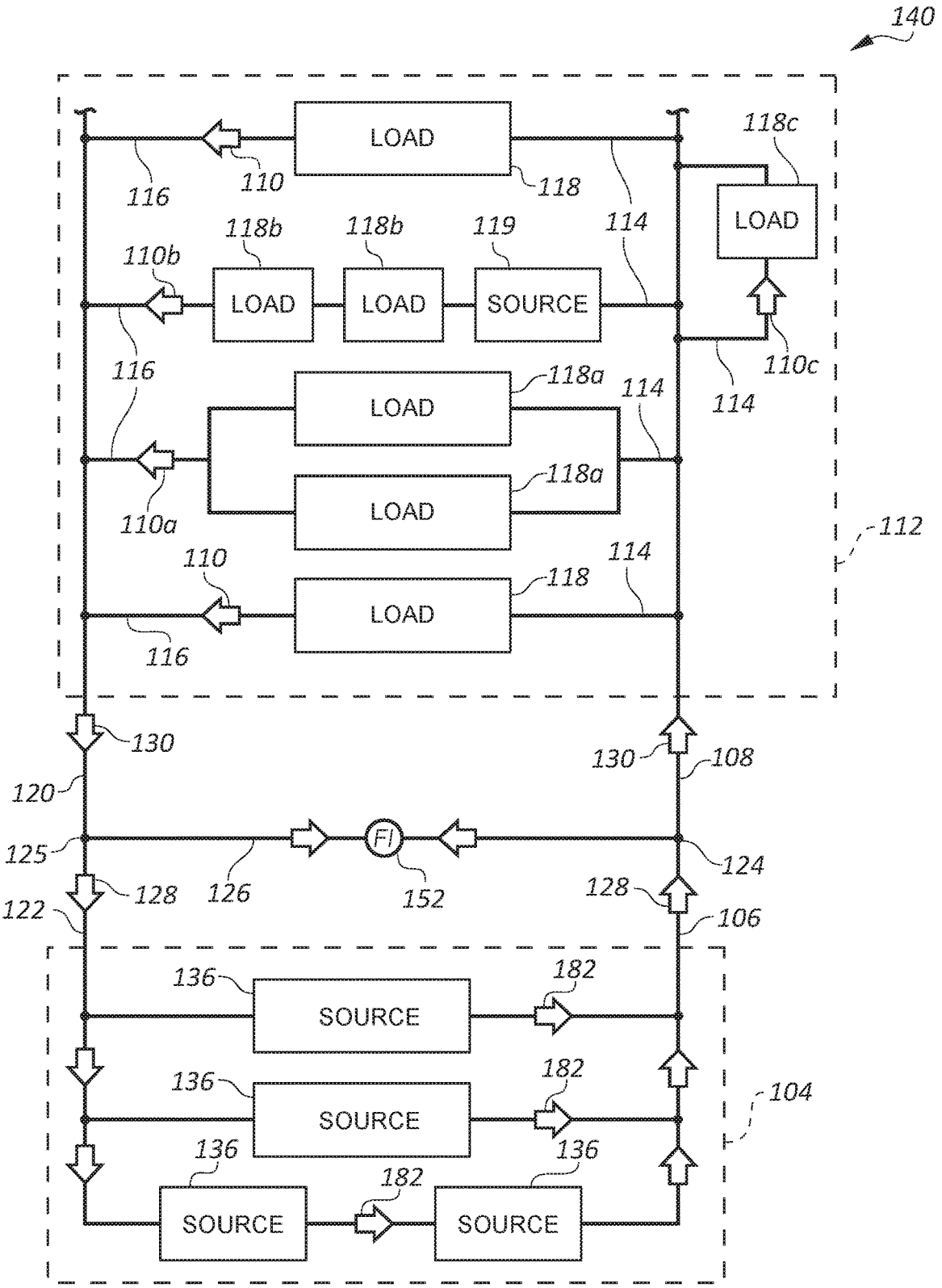
FIG. 1B Prior Art

The inventor believes that although recent advances have resulted in significant improvements in operational efficiency of known hydronic systems, further improvements can be achieved. For example, the inventor has recognized that an inherent problem in systems like the heating system 100 of FIGS. 1A-1B is that even though many, if not most of the load elements 118 of the system may not require fluid at the temperature supplied by the source 104, the set point temperature of the source must be high enough to meet the requirements of every load element in the system. Thus, for example, if only one of the load elements 118 requires fluid at 120°, the set point of the source 104 must be set to provide conditioned fluid at that temperature, even if all of the other load elements are able to operate satisfactorily with a working fluid temperature of 90° or less.

The inventor has also recognized that system efficiency and capacity could be increased for all operating conditions of an HVAC system if working fluids supplied to various load elements could be selectively supplied to the loads according to their relative temperature requirements, and if, in the case of multiple heating or cooling sources, fluid from sources with higher-temperature outputs could be selectively supplied to loads that require a higher temperature fluid, and sources with lower-temperature outputs could supply loads that require lower temperature fluid.

Description of Embodiments

Figure 2:
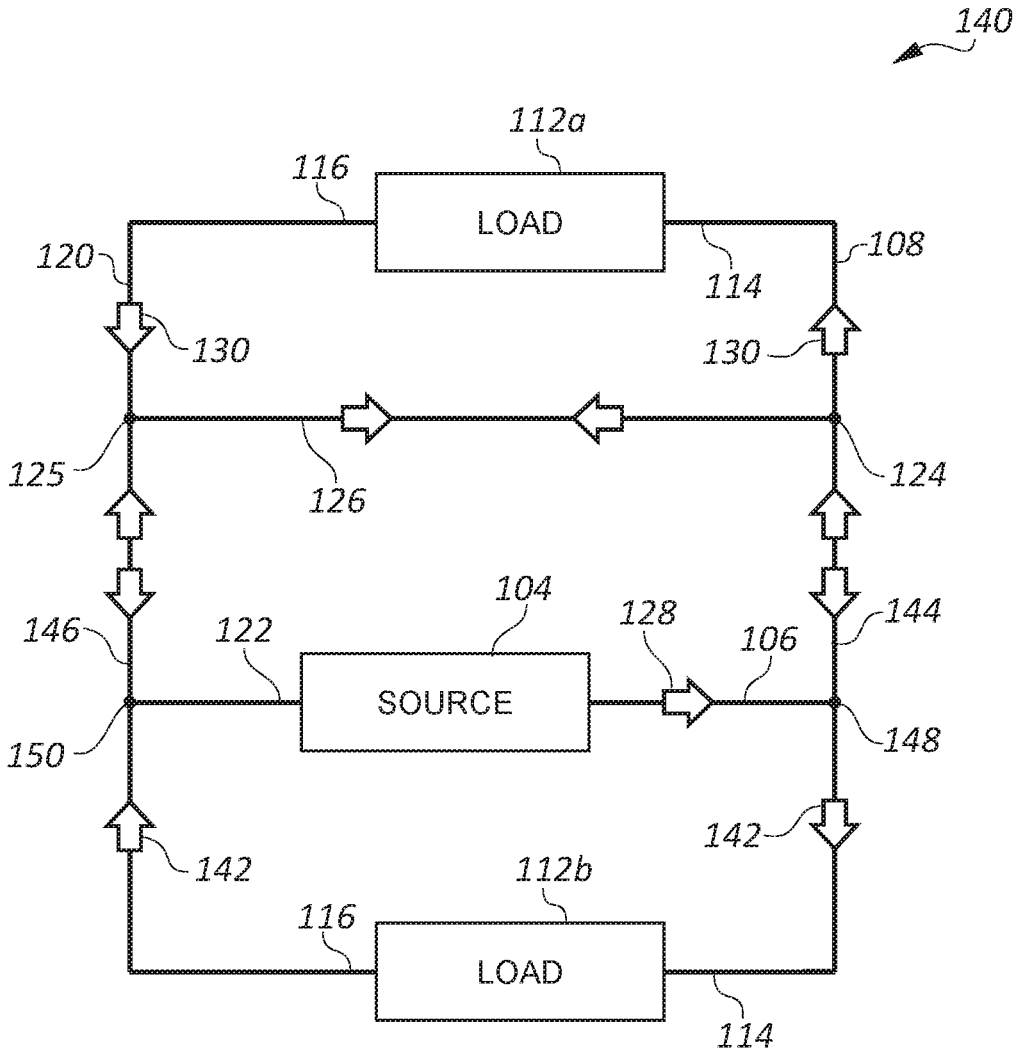
FIG. 2 is a simplified schematic diagram of a hydronic system, according to an embodiment, such as might be used in a building for HVAC.

FIG. 2 is a simplified schematic diagram of a hydronic system 140, according to an embodiment, such as might be used in a building for heating or cooling, etc. Many of the features are substantially similar to corresponding features of the system 100 described with reference to FIGS. 1A-1B, and so will not be described in detail again.

One distinction between the system of FIGS. 1A-1B and the system of FIG. 2 is the provision, in the hydronic system 140, of a lower secondary loop 142, which is shown positioned below—as viewed in FIG. 2—the source 104 and the de-coupler 126, and which is defined by the fluid path passing through a load 112*b*. A lower supply conduit 144 is provided that places an input 114 of the lower load 112*b*—i.e., the load of the lower secondary loop 142—in fluid communication with the output 106 of the source 104 and with the decoupler 126 via a supply tee 148. Similarly, a lower return conduit 146 is provided, which places the output 116 of the load 112*b* in fluid communication with the input 122 of the source 104 and with the decoupler 126 via a return tee 150. For clarity, the secondary loop 130, which is defined by the fluid path through the load 112*a*, and which is shown, diagrammatically, positioned above the decoupler 126, will be referred to hereafter as the upper secondary loop 130. Similarly, the supply conduit 108 and the return conduit 120 will be referred to hereafter as the upper supply conduit 108 and the upper return conduit 120, respectively. Furthermore, the distinction between the upper and lower supply conduits, and the upper and lower return conduits, as also for clarity. In some physical embodiments they may be continuous pipes, with no obvious separation except for the coupling to the decoupler. In other embodiments, they may be in the form of a number of short pipes or transmission lines extending between other system components.

The provision of the supply and return tees 148, 150 is another significant distinction between the system 140 of FIG. 2 and the prior art system 100 described with reference to FIGS. 1A and 1B. Referring to the system 100 of FIG. 1A, it can be seen that fluid from the output 106 of the source 104 must flow to the first decoupling tee 124, while fluid returning to the source input 122 comes only from the second decoupling tee 125. In contrast, in the embodiment of FIG. 2, the source output 106 is coupled to the supply tee 148, so that fluid can flow toward the first decoupling tee 124 or toward the lower secondary loop 142, or can divide, with a portion of the flow going in each direction. Likewise, the source input 122 is coupled to the return tee 150 and can therefore receive fluid from either the second decoupling tee 125 or from the lower secondary loop 142, or from both. This novel configuration results in some significant distinctions in the operation of the system 140, as compared to prior art systems. The operation of the system 140 is described in some detail below with reference to FIGS. 3A-3D.

It should be noted that in the embodiment shown in FIG. 2, the decoupler 126 is positioned, in the fluid circuit, between the load 112*a* of the upper secondary fluid loop 130, on one side, and the source 104 and the load 112*b* of the lower secondary fluid loop 142, on the other side. In particular, it can be seen that fluid in the lower secondary loop 142 that follows a path from the load 112*b* through the source 104 then back to the load 112*b* does not also pass through the first and second decoupling tees 124, 125. In contrast, fluid in the upper secondary loop 130 that follows a path from the load 112*a* through the source 104 then back to the load 112*a* must also pass through the first and second decoupling tees 124, 125, and so may be modified by fluid flowing in the decoupler 126, as previously described.

Broadly speaking, the system 140 operates in a manner that is similar to the operation described above with reference to the system 100 of FIGS. 1A-1B. However, there are some important differences. For example, in the hydronic system 140, the fluid of the lower secondary loop 142 is largely insulated from dilution by fluid in the decoupler 126 by it position relative to the source 104. Because the output 106 of the source 104 shares the supply tee 148 with the input 114 of the load 112*b*, the load 112*b* automatically takes priority over the load 112*a* of the upper secondary loop 130 with respect to conditioned fluid from the source 104, i.e., the load 112*b* of the lower secondary loop 142 is the preferred load while the load 112*a* of the upper secondary loop is the non preferred load. If the flow of the lower secondary loop 142 is more than the flow of the primary loop 128, the load 112*b* takes all of the conditioned fluid from the source 104. If the flow of the lower secondary loop 142 is less than the flow of the primary loop 128, then the flow to the load 112*b* come entirely from the source 104, while only the portion of the flow that is not taken by the lower load 112*b* passes to the upper secondary loop 130. Any work done by the source 104 is preferentially supplied to the load 112*b* of the lower secondary loop 142 over the load 112*a* of the upper secondary loop 130, without the need for control valves directing the flow to the preferred load. For similar reasons, fluid from the output of the load 112*b* is preferentially supplied to the source 104, inasmuch as the input 122 of the source 104 shares the return tee 150 with the output 116 of the load 112*b*.

Figure 3A:
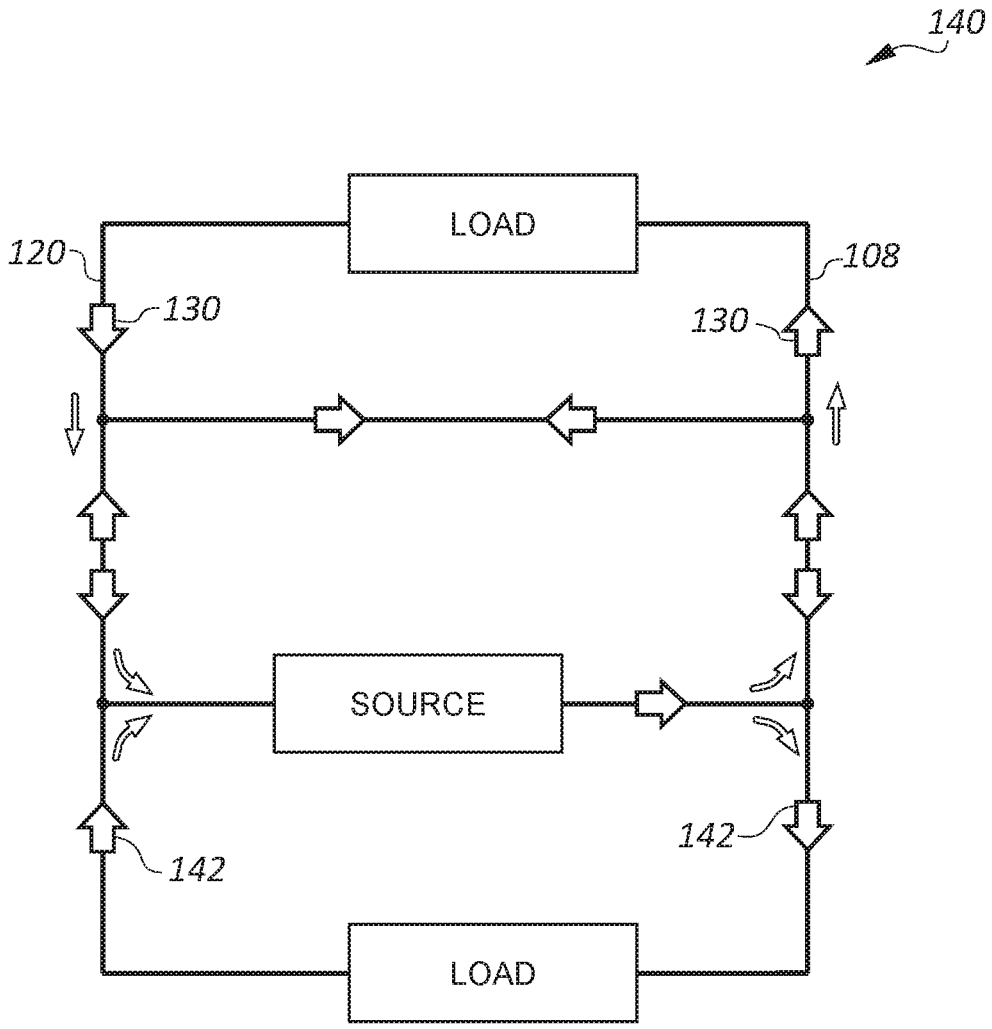
FIGS. 3A-3D are diagrams showing fluid flow in the hydronic system of FIG. 2 during operation under respective different conditions, according to an embodiment.

These principles are illustrated in the examples shown in FIGS. 3A-3D, with the system 140 operating under various conditions. Small arrows alongside conduits and tees indicate direction of flow under the conditions described. FIG. 3A illustrates a condition in which flow in the primary loop 128 is greater than the flow in the lower secondary loop 142, and in which the fluid conditioning provided by the source 104 is about equal to the total requirements of the system 140. Fluid from the source output 108 enters the supply tee 148 and divides, with a portion flowing to the load 112*b* of the lower secondary loop 142 and another portion flowing through the first decoupling tee 124 toward the load 112*a* of the upper secondary loop 130. Fluid returning to the source 104 from the upper secondary loop passes through the second decoupling tee 125 and combines with fluid returning from the lower secondary loop 142 at the return tee 150 to enter the source input 122. Because the fluid conditioning provided by the source 104 is about equal to the total requirements of the system 140, there is no flow in the decoupler 126.

Figure 3B:
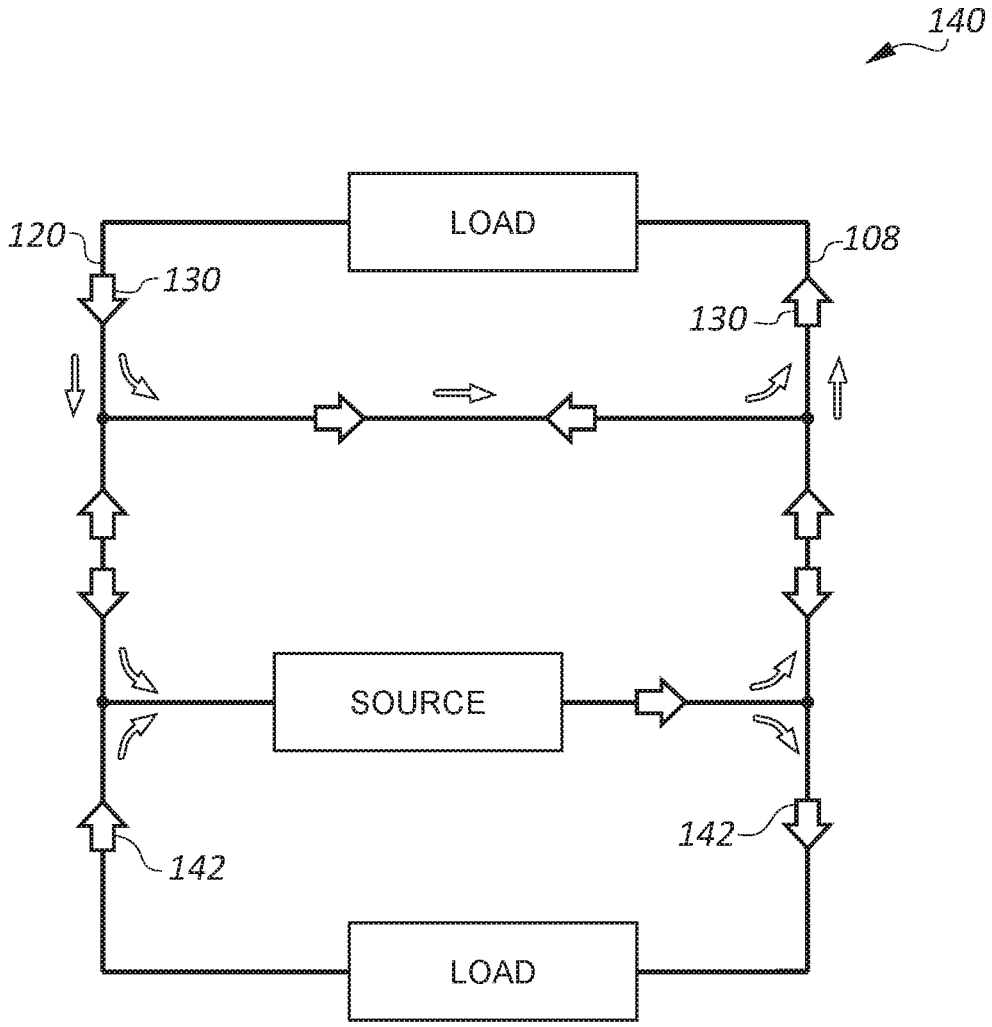

FIG. 3B illustrates a condition in which, as in the previous example, flow in the primary loop 128 is greater than the flow in the lower secondary loop 142, but in which the fluid conditioning provided by the source 104 is less than the total requirements of the system 140. As with the previous example, the flow from the source 104 separates at the source tee 148, with a portion flowing into the lower secondary loop 142 and another portion flowing toward the first decoupling tee 124, and returning fluid from the upper and lower secondary loops 130, 142 recombines at the return tee 150 as it enters the source input 122.

However, because the total demand for conditioned fluid exceeds the output of the source 104, there is a flow from the second decoupling tee 125 toward the first decoupling tee 124, as a portion of the returning fluid of the upper secondary loop is diverted back to the upper supply conduit 108, substantially as described with reference to the prior art system 100 of FIG. 1A. As a result, fluid supplied to the load 112*a* of the upper secondary loop 130 is a lower-grade blend of fluid from the source 104 and the decoupler 126. However, as shown in FIG. 3B, all of the fluid supplied to the lower secondary loop 142 is directly from the source 104, without any dilution or reduction in grade. Thus, even though the source 104 is not able to meet the requirements of all of the loads of the system 140, the requirements of the load(s) 112*b* of the lower secondary loop 142 are fully met. In fact, when the flow from the source 104 passes through the source tee 148, the entire fluid demand of the load 112*b* of the lower secondary loop 142 is accommodated before any fluid is transmitted to the upper secondary loop 130. Likewise, all of the flow from the output 116 of the load 112*b* is supplied directly to the source input 122—via the return tee 150—in preference to fluid returning from the upper secondary loop 130.

Figure 3C:
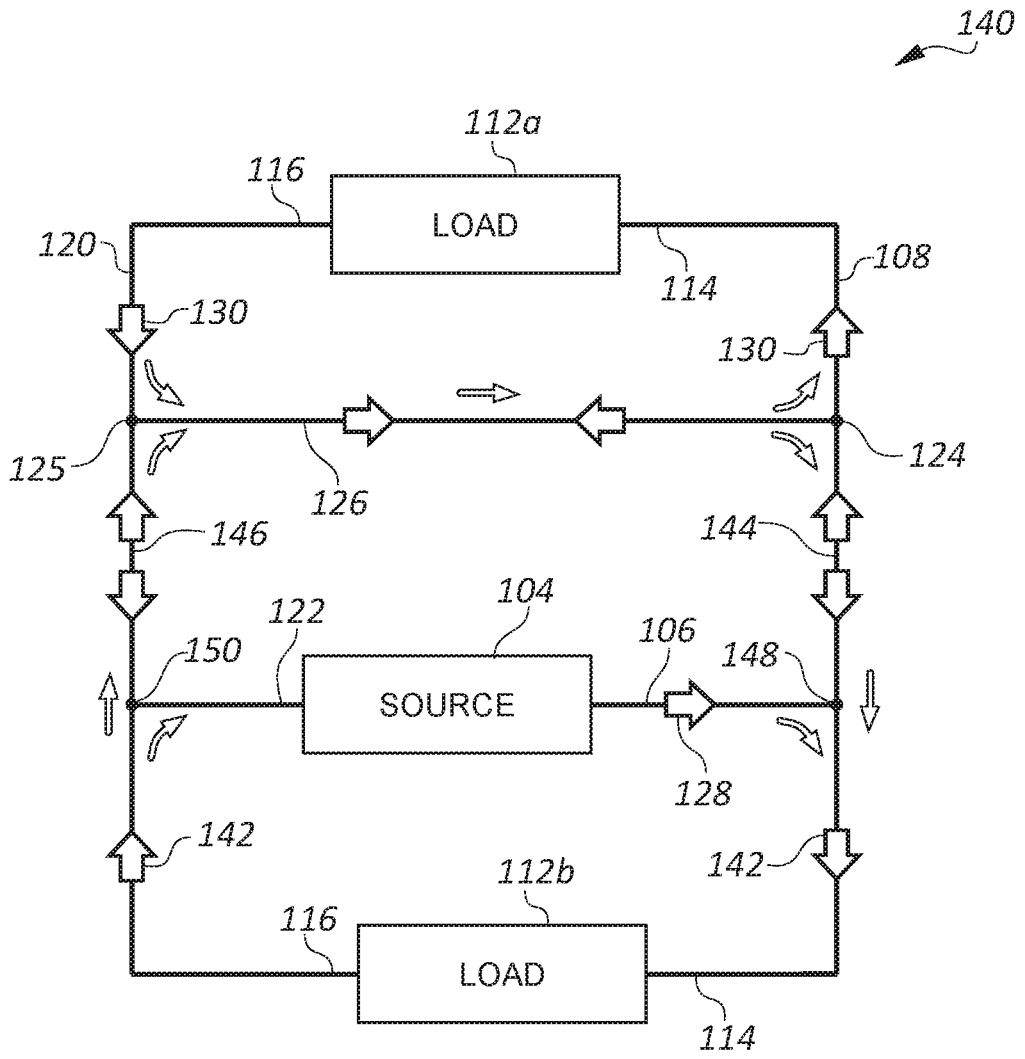

A more extreme example of this condition is illustrated in FIG. 3C, in which the fluid demand of the lower secondary loop 142 is greater than the supply from the source 104. In other words, the flow in the lower secondary loop 142 is greater than the flow in the primary loop 128. In this condition, all of the flow produced by the source 104 passes from the source tee 148 to the input 114 of the load 112*b* of the lower secondary loop. The difference between the flow drawn by the lower secondary loop 142 and the smaller flow supplied by the source 104 is drawn through the supply tee 148 from the decoupler 126 via the first decoupling tee 124. Meanwhile, fluid from the output 116 of the load 112*b* divides at the return tee, with a portion passing into the source input 122 and the balance returning to the upper secondary loop via the second decoupling tee 125. Of course, this means that none of the conditioned fluid from the source 104 is supplied directly to the upper secondary loop 130. Instead, fluid in the upper supply conduit 108 is from the decoupler 126, via the first decoupling tee 124.

It can be seen that when the source 104 cannot meet the requirements of the lower secondary loop 142, all of the fluid produced by the source 104 is supplied to the lower secondary loop, while none is supplied to the upper secondary loop 130. This operating condition also results in another aspect that distinguishes the system 140 from the prior art: in the example of FIG. 3C, the direction of flow in the lower supply conduit 144 and the lower return conduit 146 is reversed from the direction shown in other examples and in the prior art. It can be seen that in the system 140, direction of flow in the lower supply conduit 144 extending between the supply tee 148 and the first decoupling tee 124 can be in either direction, depending upon the operating conditions, and in particular on the requirements of the load 112*b* of the lower secondary loop 142 relative to the supply of conditioned fluid by the source 104. Likewise, direction of flow in the lower return conduit 146 extending between the return tee 150 and the second decoupling tee 125 can be in either direction, depending upon operating conditions.

As illustrated in the examples of FIGS. 3A-3C, in the hydronic system 140, the provision of the supply and return tees 148, 150 and a lower secondary loop coupled to the source 104 without an intervening decoupler results in the lower secondary loop 142 always being supplied preferentially over the upper secondary loop 130. This provides a number of advantages. For example, a system designer can position critical or essential load elements in the lower secondary loop, where they will have priority access to the conditioned fluid from the source 104 over less critical or essential load elements.

Figure 3D:
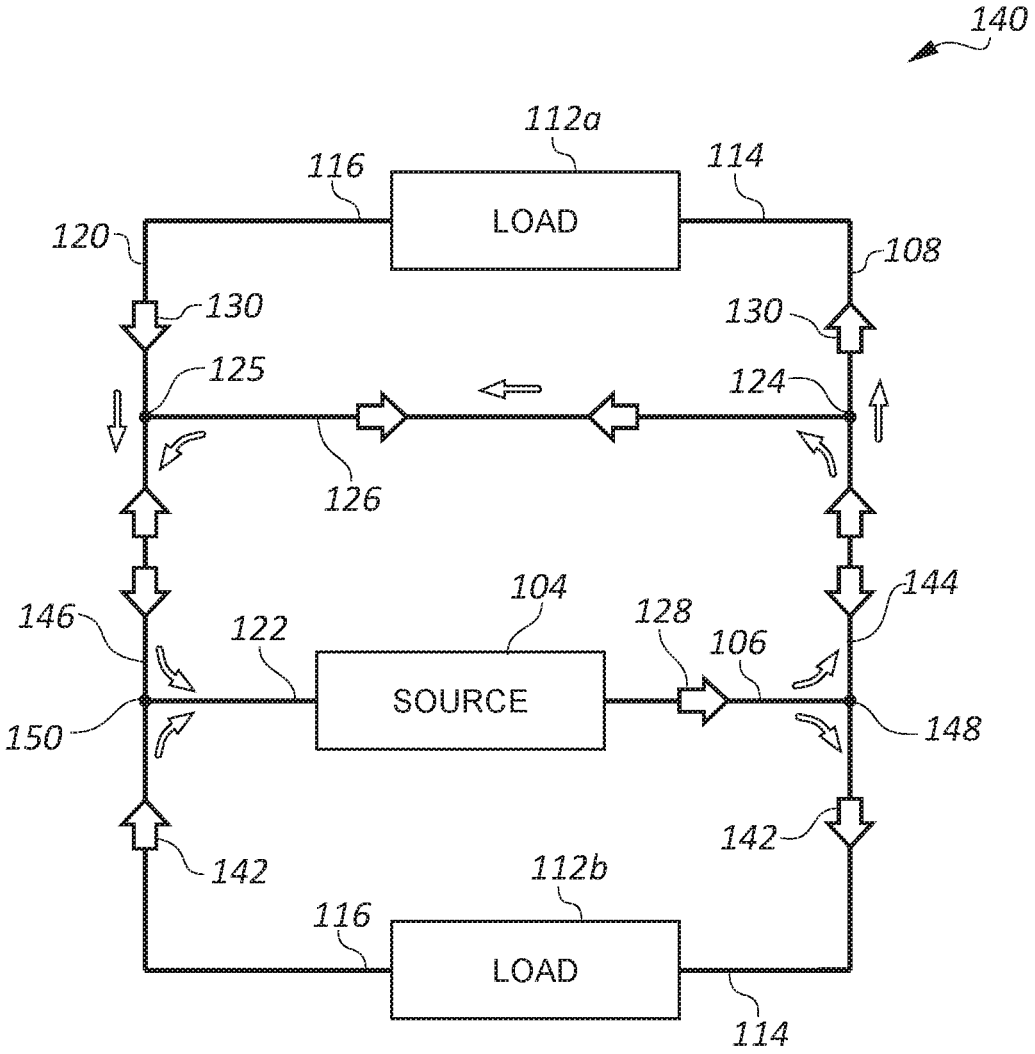

FIG. 3D illustrates a condition in which flow in the primary loop 128 is greater than the flow in the lower secondary loop 142, and in which the fluid conditioning provided by the source 104 exceeds the total requirements of the system 140. Under these circumstances, fluid from the source output 108 enters the supply tee 148 and divides, with a portion flowing to the load 112*b* of the lower secondary loop 142 and another portion flowing through the first decoupling tee 124 toward the load 112*a* of the upper secondary loop 130. Fluid returning to the source 104 from the upper secondary loop passes through the second decoupling tee 125 then combines with fluid returning from the lower secondary loop 142 at the return tee 150 to enter the source input 122. Because the flow from the source 104 exceeds the total load requirements, the flow in the lower supply conduit 144 divides at the first decoupling tee 124, with the flow necessary to meet the requirements of the load 112*a* of the upper secondary loop 130 entering the upper supply conduit 108, and the remaining fluid passing through the decoupler 126 to the second decoupling tee 125, where it combines with the flow returning from the load 112*a*, passing thence to the return tee 150 to combine with the flow from the lower secondary loop 142 before entering the source input 122.

A comparison of the flow patterns illustrated in FIGS. 3A-3D will show that during operation of the system 140, supply of conditioned fluid to the lower secondary loop 142 remains consistent and without change or reduction in quality under most circumstances. Only when all of the conditioned fluid produced by the source 104 is still not adequate to meet the requirements of the lower load 112*b* does the fluid quality supplied to the lower secondary loop 142 diminish.

Load elements of the lower load 112*b* are supplied with fluid at the set point temperature of the source for as long as the source 104 produces a flow at least equal to the demand of the lower load, because the output of the source is preferentially provided to the lower load. However, these benefits can be significantly improved through attention to the design of the system.

Figure 4:
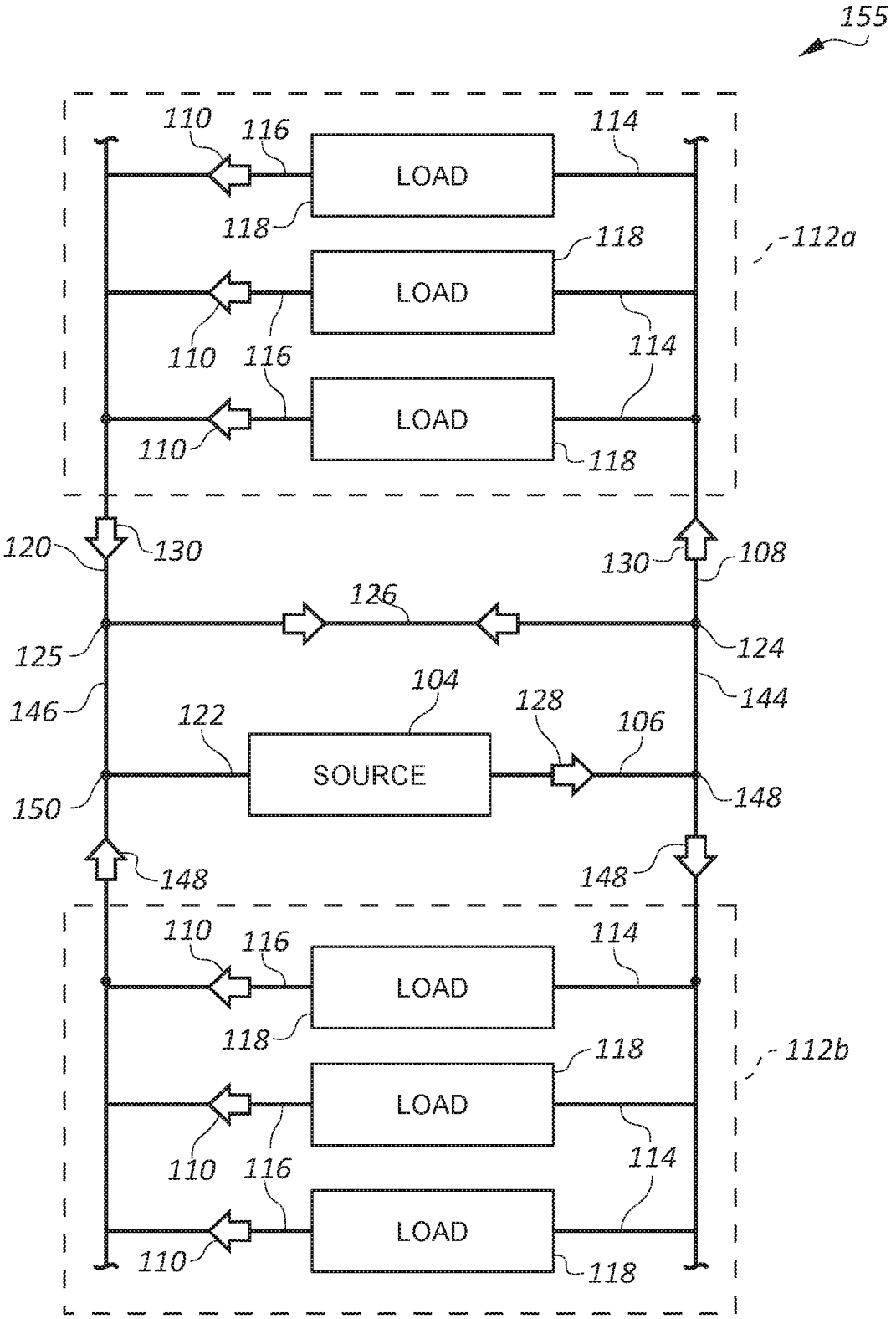
FIG. 4 is a simplified schematic diagram of the hydronic system of FIG. 2, showing an example in which thermal loads of the upper and lower secondary loops each include respective pluralities of sub-loops and load elements, according to an embodiment.

FIG. 4 is a simplified schematic diagram of a hydronic system 155, according to an embodiment. The system 155 includes all of the elements described with reference to the system 140 of FIG. 2. In the system 155, the thermal load 112*a* of the upper secondary loop 130 and the thermal load 112*b* of the lower secondary loop 142 each include respective pluralities of sub-loops 110 with respective load elements 118. The hydronic system 140 of FIGS. 2 and 3A-3D is shown and described in an extremely simplified form in order to simplify the description of the basic principles of operation. In practice, embodiments are typically more complex than any of the embodiments described herein, often with many source and load elements, interconnected by networks of conduits, often in combinations of series and parallel connections, or with branching elements, etc. Nevertheless, a person having ordinary skill in the art will recognize that most such systems can be reduced to simpler schematic diagrams, with each element of the diagram representing a corresponding plurality of physical elements. In the embodiment of FIG. 4, the system 155 includes multiple load elements 118, which themselves can individually represent, for example, the air handling units of a respective floor of an office building, or all the refrigeration elements of a respective building or lab of a research facility, etc. In particular, unless explicitly defined as such, the use of terms such as load and source, in the singular, is not to be construed as limiting a claim to a single load or source device. In operation, the system 155 of FIG. 4 functions substantially as described with reference to the system 140 of FIG. 2.

According to an embodiment, during the planning and construction of the hydronic system 155, the load elements 118 of the system are sorted according to criticality. The load elements associated with more critical or essential functions are incorporated into the lower secondary loop 142, and the remaining load elements, presumably those serving functions that are of lower importance or criticality, are incorporated into the upper secondary loop. Accordingly, under operational conditions in which the source is not able to meet the requirements of all of the load elements of the system, the more critical elements are prioritized over the other elements.

According to another embodiment, during the planning and construction of the hydronic system 155, the load elements 118 of the system are sorted according to the fluid temperature requirements of each of the elements. The load elements 118 that require relatively higher-grade working fluid—i.e., higher temperature fluid—as compared to the other load elements, are incorporated into respective sub-loops of the upper secondary fluid loop 130. Meanwhile, the load elements 118 that require relatively lower-grade working fluid are incorporated into respective sub-loops of the lower secondary fluid loop 142. The distribution can, according to an embodiment, be selected such that most of the load elements of the system are in the lower secondary loop 142.

According to an embodiment, the set point temperature of the source 104 is configured to be reduced under circumstances like those described, i.e., when the demands on the system exceed the capacity or current output of the source. For example, when the flow rate through the source 104 is reduced to a selected threshold, or the temperature of fluid at a selected point in the upper secondary loop drops to a selected temperature threshold, the set point of the source is reduced to a temperature that is about equal to the highest temperature required by any of the load elements of the lower secondary loop 142. With a reduced set point temperature, the source 104 will not be able to fully meet the high-grade fluid requirements of the load elements of the upper secondary loop 130. However, with the lower temperature, the source 104 will be able provide conditioned fluid that meets the requirements of all of the load elements of the lower secondary loop 142.

The operation described above, and the improvements in efficiency and performance provided, are automatic, and independent of any control or monitoring system. This is surprising, because it is achieved by a simple rearrangement of a few of the elements of the system, and is self-regulating, while some known hydronic systems employ extremely complex control systems without achieving comparable results.

It should be noted that the efficiency advantages described above with respect to the HVAC systems 140 and 155 of FIGS. 2-4 are realized primarily during periods in which the total system demand for conditioned fluid exceeds the total fluid output of the source. During periods in which the source is able to meet all of the system requirements, the system operates at an efficiency level that is similar to that of the system 100 of FIG. 1.

In contrast, the operation described below with respect to the hydronic system 180 of FIG. 5 can provide significant improvements in system efficiency under all operating conditions, so the advantages and benefits are obtained continually. Furthermore, these advantages and benefits are inherent in the system, and are independent of any control system associated with the hydronic system, etc.

Figure 5:
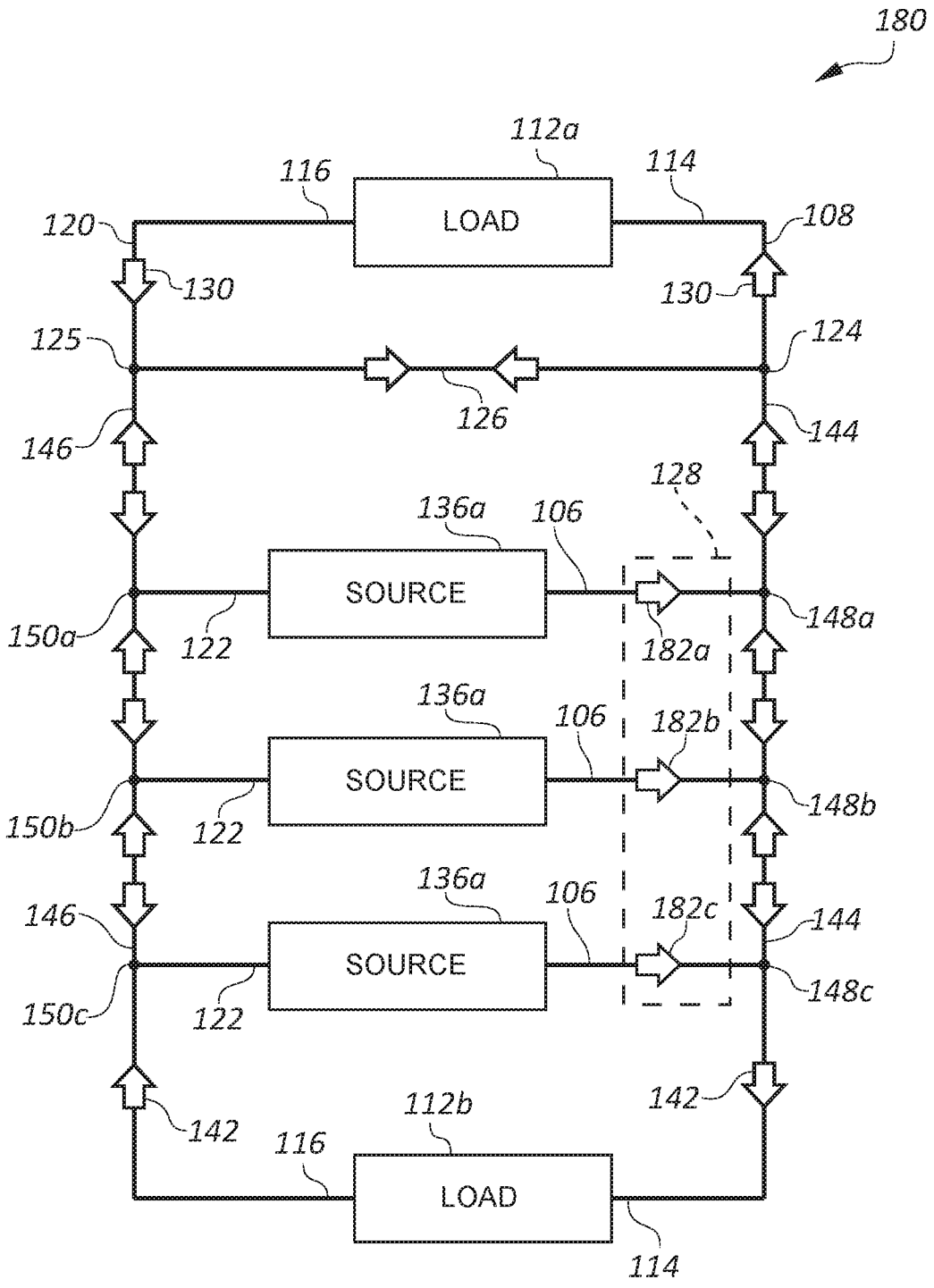
FIG. 5 is a simplified schematic diagram of a hydronic system 180, according to another embodiment, in which the primary loop is shown to include a plurality of source loops with respective source elements.

FIG. 5 is a simplified schematic diagram of a hydronic system 180, according to an embodiment. The system 180 is similar in most respects to the system 140 of FIG. 2. However, the primary loop 128 includes a plurality of source loops 182*a*-182*c* coupled in parallel between the lower supply conduit 144 and the lower return conduit 146. Each of the source loops 182 includes a source element 136*a* with an input 122 coupled to the lower return conduit 146 via a corresponding return tee 150, and an output 106 coupled to the lower supply conduit 144 via a corresponding supply tee 148. The supply tees 148*a*-148*c* are coupled in series in the lower supply conduit 144 and the return tees 150*a*-150*c* are coupled in series in the lower return conduit 146. In the hydronic system 180, the primary loop 128 is defined collectively by the fluid paths through the source elements 136*a*-136*c*.

According to an embodiment, during the planning and construction of the hydronic system 180, the load elements of the system are sorted according to the fluid temperature requirements of each of the elements. The load elements that require relatively higher-grade working fluid are incorporated into respective sub-loops of the upper secondary fluid loop 130, while the load elements that require relatively lower-grade working fluid are incorporated into respective sub-loops of the lower secondary fluid loop 142.

According to another embodiment, the load elements are divided into two groups according to their temperature requirements, with the division between the groups being selected to correspond to a large temperature gap between a first group of load elements and a second group of load elements, the group with the higher-grade fluid requirements being incorporated into the upper secondary loop 130, and the lower-grade load elements being incorporated into the lower secondary loop 142.

According to an embodiment, the source loops 182*a-c* of the system 180 are arranged and configured so that the source element 136*a*, which is closest to the decoupler 126, has the highest set point of the plurality of sources 136*a-c*. The set point of the uppermost source element 136*a* is selected to be sufficient to meet the highest-grade fluid requirement of the plurality of load elements of the upper secondary loop 130. The set points of the remaining source elements 136*b*, 136*c* are selected to be sufficient to meet the low-grade fluid requirements of the load elements of the lower secondary loop 142.

It will be recalled that in the system 140 of FIGS. 2-3D, the load 112*b* of the lower secondary loop 142 cannot draw fluid from the decoupler 126 unless it is already drawing all of the fluid output of the source 104 into the lower secondary loop 142, i.e., the condition described with reference to FIG. 3C. Fluid cannot flow in a fluid line or coupling in opposite directions simultaneously. As long as fluid from the source 104 is flowing upward from the supply tee 148 toward the first decoupling tee 124, fluid cannot also flow downward into the supply tee from the first decoupling tee toward the lower secondary loop 142. The same principle prevents the load 112*b* of the lower secondary loop 142 from drawing fluid from the middle or upper source loops 182*b*, 182*a* during operation of the hydronic system 180 unless it also draws all of the flow from the lower source loop 182*c*. If there is an upward flow of fluid from the lower supply tee 148*c*, there cannot also be a downward flow through the same tee toward the input 114 of the lower load 112*b*. Likewise, the lowermost source loop 182*c* cannot supply fluid to the upper secondary loop 130 without first meeting all of the fluid demands of the load 112*b* of the lower secondary loop 142. Accordingly, the lower-grade fluid from the lowest source loop 152*c* will preferentially supply the fluid requirements of the load 112*b* of the lower secondary loop 142, which is the load with the lowest-grade fluid requirements. By the same token, the high-grade working fluid from the upper source 136*a*, which is closest to the loads 112*a* of the upper secondary loop 130, is preferentially supplied to the loads with the higher-grade fluid requirements. Additionally, the return fluid from the load 112*b* of the lower secondary loop 142 will be returned first to the source 104*c*, which is closest to the lower secondary loop, while the fluid returned from the load 112*a* of the upper secondary loop 130 will be supplied first to the source element 136*a*, closest to the upper secondary loop. As a consequence, the lower-grade return fluid is automatically returned first to the lower source 104*c* with the lowest-grade temperature set point, while the higher-grade return fluid is automatically returned first to the upper source element 136*a* with the highest-grade temperature set point.

The source loop (or loops) 182*b* that is positioned between the upper source loop 182*a* and the lower source loop 182*c* provides conditioned fluid to, and receives returning fluid from the sub-loops of the upper and lower secondary fluid loops 130, 142 according to the flow of fluid drawn by the respective loads 112*a*, 112*b* and the flow conditioned by the sources 136*a*, 136*c* of the other source loops 182*a*, 182*c*. For example, if the load 112*b* of the lower secondary loop 142 draws more fluid than can be provided by the source 136*c* of the lower source loop 182*c* alone, the balance will be drawn first from the second-lowest source loop 182*b*, which will also receive the same proportion of fluid in the lower return conduit 146 from the lower secondary loop. The balance, if any, of the working fluid conditioned by the middle source loop 182*b* will of course be carried upward in the supply conduit 108 to the upper secondary loop 130 and the decoupler 126.

According to an embodiment, the system 180 operates in a facility in which a majority of load elements require relatively low-grade fluid, with a minority of load elements having high-grade fluid requirements. Accordingly, the smaller number of high-grade load elements are configured as elements of the upper secondary loop 130 of the system 180 and the remaining load elements are configured as elements of the lower secondary loop 142. The lower fluid source element 136*c*, or the two lower fluid source elements 136*c* and 136*b* together, are configured to condition most of the working fluid of the system 180 as low-grade fluid, with a relatively small proportion of the fluid being conditioned by the upper source element 136*a* as high-grade fluid.

During operation, the load elements of the lower secondary loop 142 are automatically supplied with lower grade primarily fluid by the lower most source element 136*c* or elements 136*c*, 136*b*, while the elements requiring high-grade fluid are automatically supplied primarily by the upper source element 136*a*. Because the temperature difference between high- and low-grade fluids in a given system can be 50° or more, and because even a change of one or two degrees in the set point temperature of a source element can have a noticeable impact on operational efficiency of that element, by conditioning most of the fluid in a system as low-grade, a very significant improvement in total system efficiency can be achieved, particularly as compared to a system in which all of the source elements operate at a common set point that is at least equal to the highest-grade load requirement in the system in spite of the fact that most of the load elements of the system could operate with much lower grade fluid.

Depending upon the respective flows of the upper and lower secondary loops 130, 142 relative to the flow of the primary loop 128 and the flows of the individual source loops 182, the flows within the lower supply conduit 144 and the lower return conduit 146 can divide at any of the supply and return tees 148, 150 and flow in opposite directions within the respective conduits. For example, if the flow drawn by the lower load 112*b* is greater than the flow in the lower source loop 182*c*, but less than the flows in the lower and middle source loops 182*c*, 182*b*, then the flow in the middle source loop 182*b* will divide at the middle supply tee 148*b*, with a portion flowing downward toward the load 112*b* and the balance flowing upward toward the upper secondary loop 130. The downward portion will combine with the flow in the lowermost source loop in the lower supply tee 148*c*, which will also flow downward toward the load 112*b*, and the upper portion of the flow from the middle supply tee will combine, in the upper supply tee 142, with the flow from the upper source loop 182*a*. Thus, flow within the lower supply conduit 144 will flow in opposite directions, outward from the middle supply tee 148*b*. The lower return tee 146 will have a corresponding flow pattern, with fluid flowing in opposite directions toward the middle return tee 150*b*.

As operating conditions change, flow within the supply conduit 144 can reconfigure, and divide and flow in opposite directions from any of the supply tees, or can divide at the first decoupling tee 124 so that all of the flow in the lower supply conduit 144 is toward the lower load 112*b*, while any flow in the upper supply conduit 108 is upward, toward the upper load 112*a*. With any such changes of flow configuration in the lower supply conduit 144, a corresponding reconfiguration will occur in the lower return conduit 146.

This arrangement, in which multiple source elements are coupled in parallel between supply and return conduits via respective supply and return tees, provides the system 180 with significant flexibility to accommodate changes in operating conditions, while also providing the potential for significantly improved efficiency, compared to the prior art in equivalent conditions.

Figure 6:
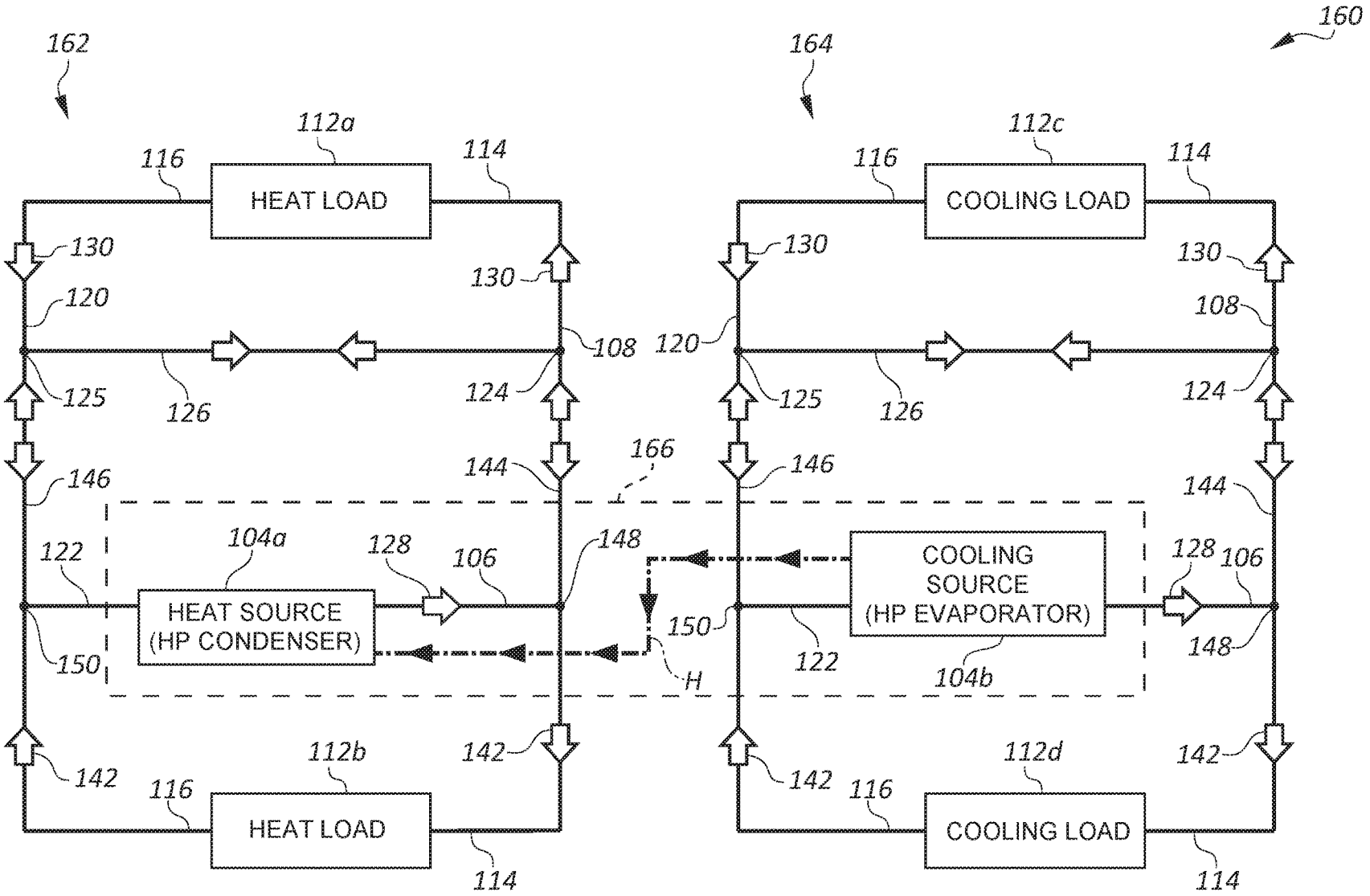
FIG. 6 is a simplified schematic diagram of an integrated thermal energy management system, according to an embodiment, which includes a first hydronic system configured as a heating system, and a second hydronic system configured as a cooling system.

FIG. 6 is a simplified schematic diagram of an integrated thermal energy management system 160, according to an embodiment. The integrated system 160 includes a first hydronic system 162 and a second hydronic system 164, each of which is a separate closed-fluid system. The first system 162 is configured as a heating system, similar to the hydronic system 140 described above with reference to FIG. 2, while the second system 164 is a cooling system that includes elements that are analogous to elements described with reference to the system 140. For example, the first and second hydronic systems 162, 164 each include a respective primary fluid loop 128 with a source 104, upper and lower secondary fluid loops 130, 142 with corresponding upper and lower loads 112, a decoupler 126, etc.

The source 104*a* of the first hydronic system 162 is a heat source, configured to impart thermal energy to the working fluid of the first system, while the source 104*b* of the second system 164 is a cooling source, configured to remove thermal energy from the working fluid of the second system. The loads 112*a*, 112*b* of the first system 162 are heat loads, configured to transfer thermal energy from the working fluid of the first system to respective thermal demand elements, while the loads 112*c*, 112*d* are configured as cooling loads, configured to transfer thermal energy from respective thermal demand elements to the working fluid of the second system.

According to an embodiment, the source 104*a* of the first hydronic system 162 and the source 104*b* of the second system 164 are, respectively, the condenser and the evaporator of a heat pump 166 that is configured to transfer thermal energy H from the working fluid of the second hydronic system 164 to the working fluid of the first hydronic system 162.

It is common, even in systems that employ heat pump technology, for heating and cooling systems to be completely separate and independent. However, this means that all of the heat collected in a cooling system must be disposed of as waste heat, while, in a heating system operating in the same environment, heat must be separately generated or drawn in from the exterior of the facility, to dispose of what might be thought of as "waste cold." However, during operation of the integrated system 160 of FIG. 6, waste heat collected by the second hydronic system 164 is reclaimed for use by the first system 162. Tus, the only heat generation or disposal necessary in the integrated system 160 is to balance the system. This provides a significant savings over systems in which heating and cooling operations are completely independent.

During periods in which the relative demands on the first and second hydronic systems 162, 164 are approximately equal, there is no requirement for supplemental heat production or cooling. However, when one of the systems has a relatively higher demand, the other system can be configured to make up the difference.

Figure 7:
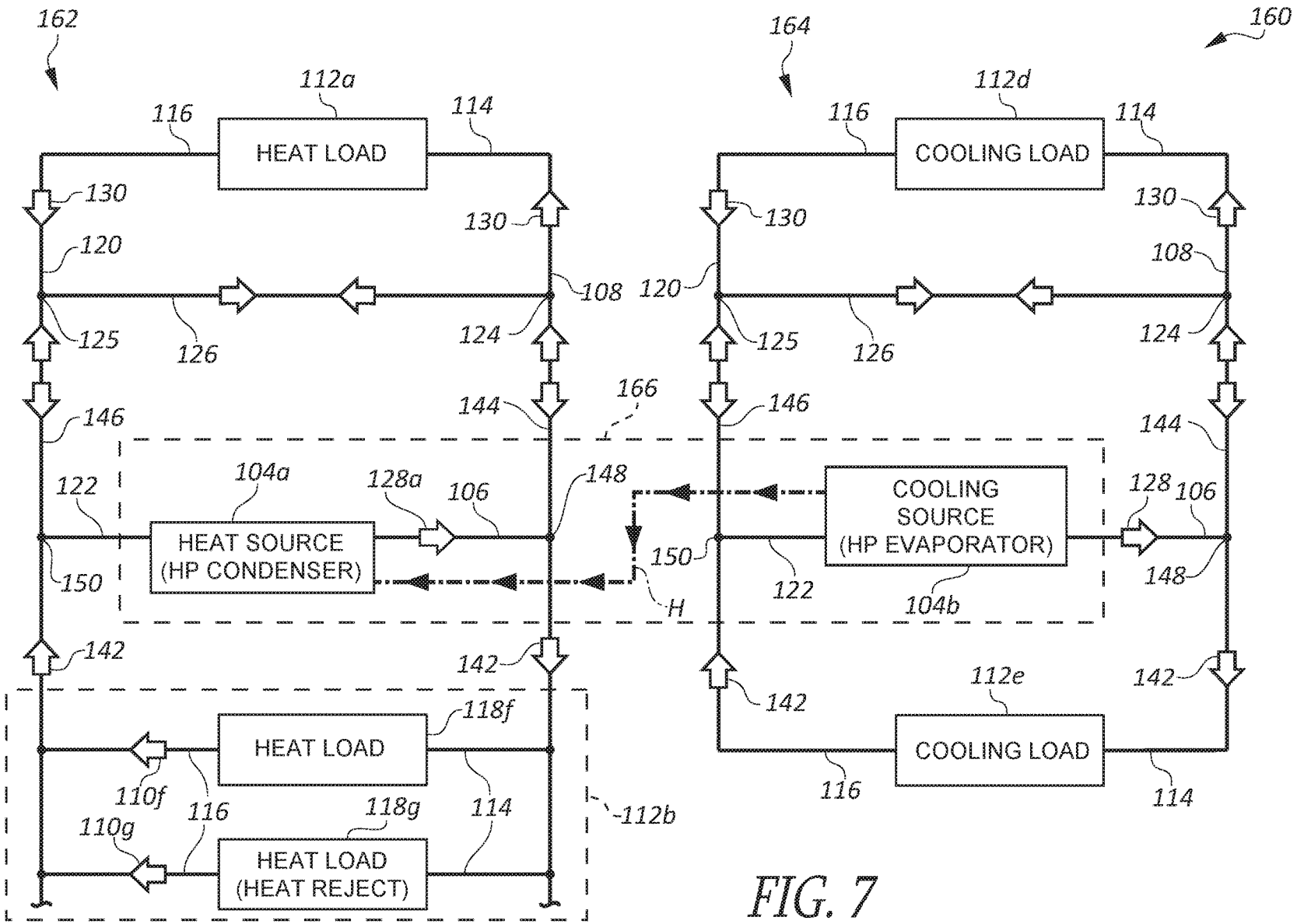
FIG. 7 is a schematic diagram showing the integrated thermal management system of FIG. 6, according to an embodiment, in which the first hydronic system is configured to dispose of excess heat collected by the second hydronic system, in order to balance the integrated system during periods in which the total cooling demands on the system exceed the total heating demands.

FIG. 7 is a schematic diagram showing the integrated thermal management system 160 of FIG. 6, according to an embodiment, in which the first hydronic system 162 is configured to dispose of excess heat collected by the second hydronic system 164, in order to balance the integrated system 160 during periods in which the total cooling demands on the system exceed the total heating demands. The first hydronic system 162 includes first and second sub-loops 110*f*, 110*g* in the lower secondary loop 142 with corresponding first and second heat load elements 118*f*, 118*g*. The second heat load element 118*g* is configured to dissipate heat to the exterior. The second load element 118*g* can be a cooling tower or any other appropriate structure capable of rejecting waste heat from the working fluid of the first system 162.

When the flow in the primary loop 128*a* exceeds the total demand for conditioned fluid, the excess flow passes through the decoupler 126 and returns to the source 104*a*, as previously described, for example, with reference to FIG. 3D. Meanwhile, as fluid flow in the decoupler 126 from the first decoupling tee 124 toward the second decoupling tee 125 rises, signaling a surplus of thermal energy in the first hydronic system 162, the second heat load element 118*g* is controlled to begin to draw fluid through the sub-loop 110*e* and the second heat load element 118*g*. The second heat load element 118*g* is configured as a "heat rejection" element, i.e., an element configured to dispose of waste heat. Accordingly, the second heat load element 118*g* transfers thermal energy from the heat. Accordingly, the second heat load element 118*g* transfers thermal energy from the working fluid of the first system 162 to a medium that is removed from the environment of the integrated thermal management system 160. This can be accomplished, for example, via thermal contact with exterior air in a heat exchanger or a cooling tower, via a geothermal cooling system, or by any other appropriate means As the flow rate in the second heat load element 118*g* increases, this increases the flow from the supply tee 148 downward toward the lower load 112*b* and thereby also decreases the flow from the supply tee upward toward the first decoupling tee, causing the flow in the decoupler 126*a* to drop. Cooled fluid from the output 116 of the second heat load element 118*e* returns to the input 122 of the source 104*a* where it combines with fluid from the lower return conduit 146 in the return tee 150, reducing the temperature of the fluid entering the source 104*a*. In response to the reduced input temperature, the source 104*a* reduces pump speed to permit the cooler fluid to reach the set point temperature, which further reduces the flow toward the decoupler.

According to an embodiment, the flow rate in the second sub-loop 110*g* is controlled to increase until the combined flows in the upper and lower secondary loops 142, 130 of the first system 162 is about equal to the flow rate in the primary loop 128 of that system, at which point the first system is disposing of all the waste heat from the second system, and the first and second hydronic systems 162, 164 are balanced. In this way, while operating as a heat load element of the first hydronic system 162, the load element 118*e* acts, effectively, as part of the cooling source 104*b* of the second hydronic system 164. The effectiveness of this configuration is enhanced by the position of the second heat load element 118*g* in the lower secondary loop 142 of the first hydronic system 162.

Figure 8:
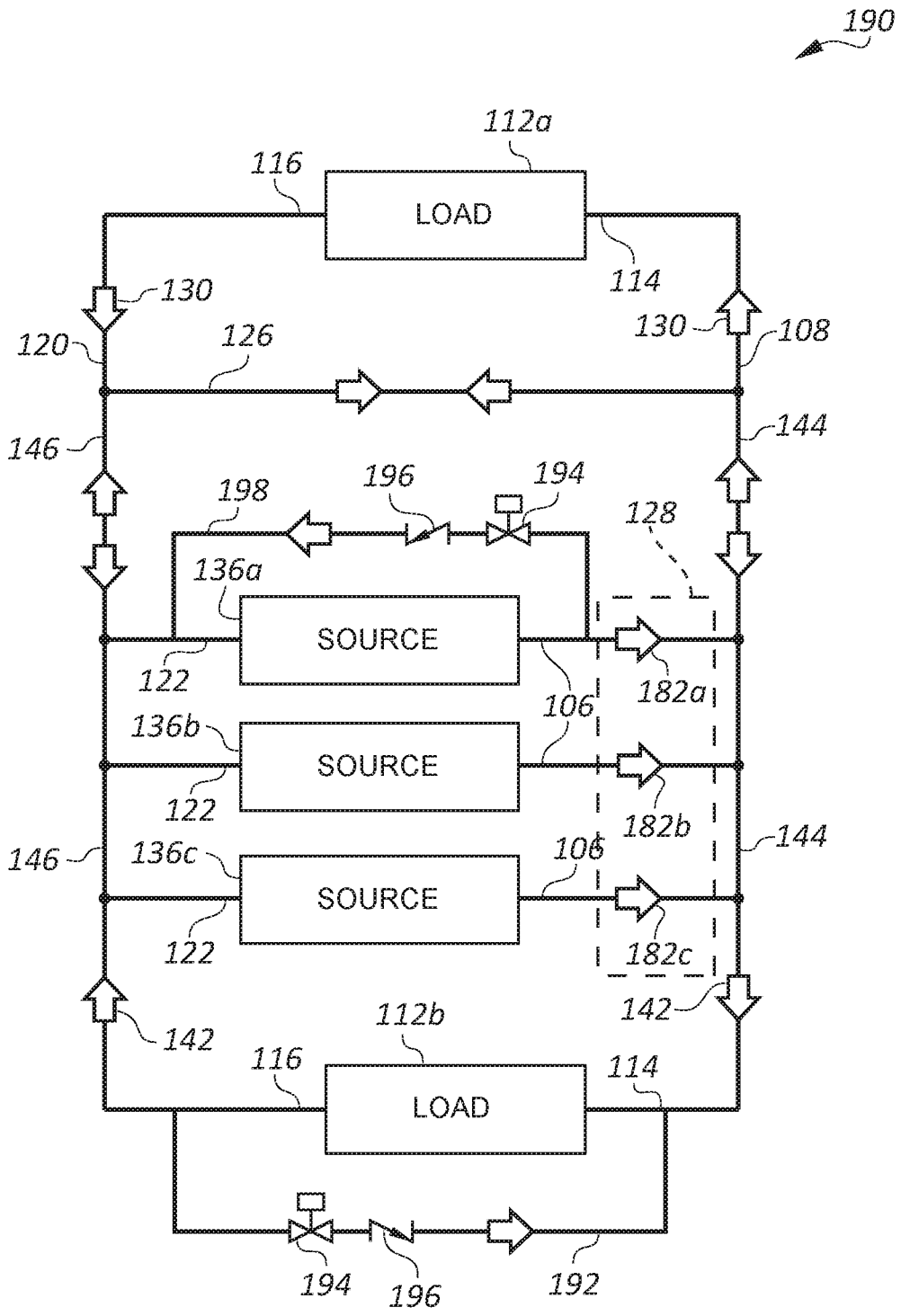
FIG. 8 is a simplified schematic diagram of a hydronic system, according to an embodiment, which is similar to the system of FIG. 5, but that further includes load and source bypass loops.

FIG. 8 is a simplified schematic diagram of a hydronic system 190, according to an embodiment. The system 190 is similar to previous embodiments, but further includes load and source bypass loops 192, 198. The load bypass loop 192 is configured to return output of the load 112*b* to its own input 114 and includes a selectively controllable valve 194 and a check valve 196. The source bypass loop 198 is configured to bypass a source element 136*a* and includes a selectively controllable valve 194 and a check valve 196.

By selectively bypassing fluid from the output 116 of the load 112*b* to the input 114, the temperature of the fluid that is supplied to the load 112*b* can be controlled, which also modifies the temperature of the fluid returning to the source 136*c*. For example, in the case of a heating system, fluid at the output 116 of the load 112*b* is cooler than at the input 114. By returning a portion of the cooled fluid in the lower 15 secondary loop 142 directly to the input of the load 112*b*, the fluid temperature at the input is reduced, and thus the output temperature is also reduced, which in turn reduces the fluid temperature at the input 122 of the lower source element 136*c*. By selectively controlling the flow in the bypass loop 192, the temperature of the fluid that is returned to the source 136*c* can be selected, at least within a range.

Similarly, by selectively bypassing fluid from the output 106 of the upper source element 136*a*, via the source bypass loop 198 the temperature at the output of that element can be regulated independently of the rate of flow through the source.

Figure 9:
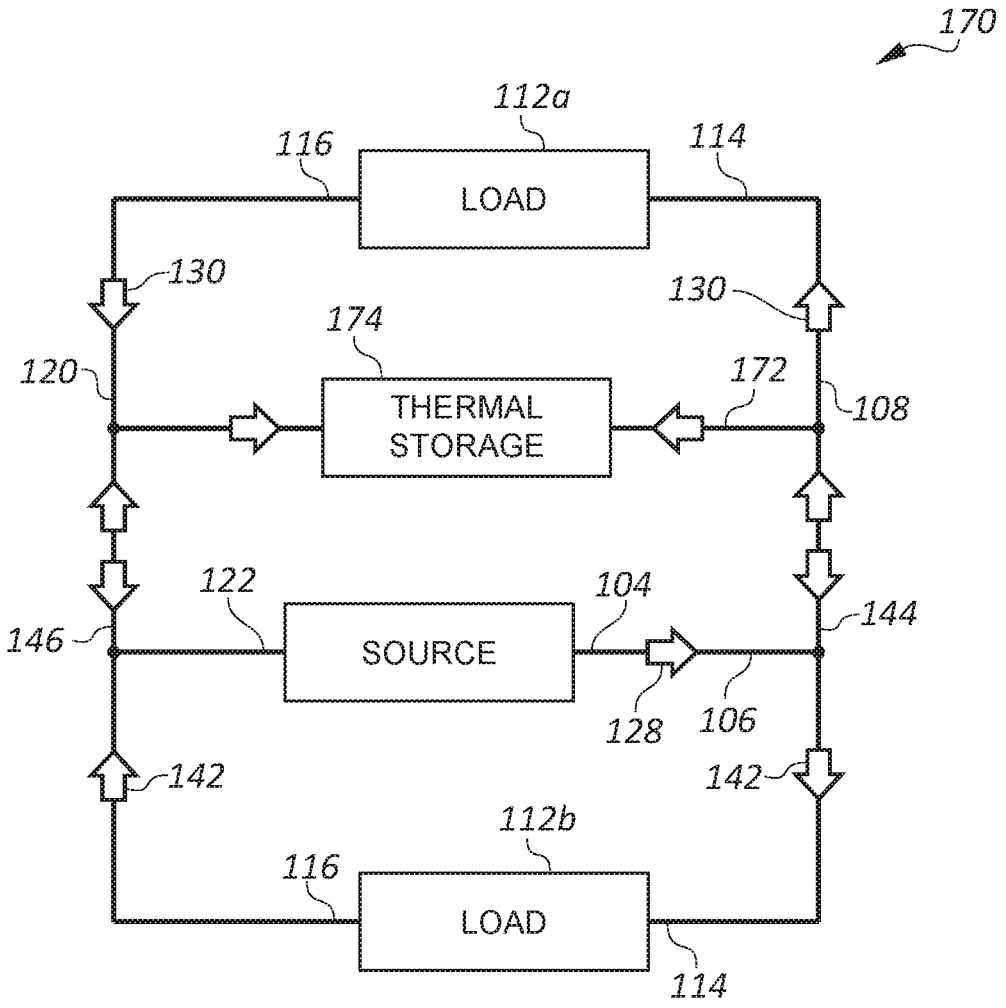
FIG. 9 is a simplified schematic diagram of a hydronic system, according to an embodiment, which includes a decoupler with a thermal storage element.

FIG. 9 is a simplified schematic diagram of a hydronic system 170, according to an embodiment. The system 170 is similar in most respects to the system 140 of FIG. 2, except that it comprises a decoupler 172 that includes a thermal storage element 174. The thermal storage element 174 can include a fluid tank, a system for storing thermal energy geothermally, or any other compatible thermal storage device or system.

In describing various embodiments of the invention, a number of different schemes for distributing the load elements of a given system between the various secondary loops and sub-loops, in order to obtain particular results and advantages. However, these schemes are provided as examples, only. The actual selection of which load elements are to be incorporate into each of the secondary loops is a matter of design choice, and can be made according to schemes like those described above, or by any other criteria chosen by a system's designers. The claims are not limited to any particular scheme except where such limitations are explicitly recited therein.

Ordinal numbers, e.g., first, second, third, etc., are used in the claims according to conventional claim practice, i.e., for the purpose of clearly distinguishing between claimed elements or features thereof, etc., without imposing further limitations on those elements. Ordinal numbers may be assigned arbitrarily, or assigned simply in the order in which elements are introduced. The use of such numbers does not suggest any other relationship, such as order of operation, relative position of such elements, etc. Furthermore, an ordinal number used to refer to an element in a claim should not be assumed to correlate to a number used in the specification to refer to an element of a disclosed embodiment on which that claim reads, nor to numbers used in unrelated claims to designate similar elements or features.

Unless the context dictates otherwise, directional language used in the claims is to be construed schematically. For example, in a hypothetical claim that recites terminals of first, second, and third elements coupled to a conduit, with the first element coupled to the conduit on a side of the second element opposite the third element, this does not require that the second element be physically positioned between the first element and the third element. Instead, this means that fluid passing through the conduit from the first element would pass a coupling to the second element before reaching a coupling to the third element.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

Elements of the various embodiments described above can be omitted or combined to provide further embodiments. Any and all U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A hydronic system, comprising:

a first fluid tee having first, second, and third terminals;

a second fluid tee having first, second, and third terminals;

a third fluid tee having first, second, and third terminals, the first terminals of the first and third fluid tees being coupled to each other;

a fourth fluid tee having first, second, and third terminals, the first terminals of the second and fourth fluid tees being coupled to each other;

a first thermal source being one of a plurality of thermal sources, each having a source input and a source output, the first thermal source having a source output coupled to the second terminal of the first fluid tee and a source input coupled to the second terminal of the second fluid tee;

a decoupler having a first terminal coupled to the second terminal of the third fluid tee and a second terminal coupled to the second terminal of the fourth fluid tee;

a first thermal load having a first load input coupled to the third terminal of the first fluid tee and a first load output coupled to the third terminal of the second fluid tee; and a second thermal load having a second load input coupled to the third terminal of the third fluid tee and a second load output coupled to the third terminal of the fourth fluid tee, wherein the first fluid tee is one of a first plurality of fluid tees that are coupled in series, with a second terminal of each of the first plurality of fluid tees being coupled to the source output of a respective one of the plurality of thermal sources, a first one of the first plurality of fluid tees having a third terminal coupled to the first load input, and a last one of the first plurality of fluid tees having a first terminal coupled to the first terminal of third fluid tee, the second fluid tee is one of a second plurality of fluid tees that are coupled in series, with a second terminal of each of the second plurality of fluid tees being coupled to the source input of a respective one of the plurality of thermal sources a first one of the second plurality of fluid tees having a third terminal coupled to the first load output, and a last one of the first plurality of fluid tees having a first terminal coupled to the first terminal of the fourth fluid tee, each of the plurality of thermal sources having a respective temperature set point, the plurality of source thermal sources being arranged such that one of the plurality of thermal sources configured to produce the highest grade fluid from among the plurality of thermal sources is positioned closest to the decoupler conduit and one of the plurality of thermal sources configured to produce the lowest-grade fluid, from among the plurality of thermal sources, is positioned closest to a first load configured to use a first grade of fluid, and a second load configured to use a second grade of fluid, the second grade of fluid that is higher grade than the first grade of fluid.

2. A hydronic system, comprising:

supply side and return side conduits;

a source having an output coupled to the supply side conduit and an input coupled to the return side conduit;

a decoupler conduit having a first end coupled to the supply side conduit and a second end coupled to the return side conduit and configured to allow bi-directional flow between the supply side and return side conduits; and a plurality of loads, each load having an input coupled to the supply side conduit and an output coupled to the return side conduit, the loads including a first load and a second load, the first load being coupled to the supply side and return side conduits on a same side of the decoupler conduit as the source, and the second load being coupled to the supply side and return side conduits on a side of the decoupler conduit opposite the source.

3. The system of claim 2, wherein:

the source is one of a plurality of source elements, each having an output coupled to the supply side conduit and an input coupled to the return side conduit;

the first load is coupled to the supply side and return side conduits on a side of the plurality of source elements opposite the decoupler conduit.

4. The system of claim 3, wherein:

each of the plurality of source elements has a respective temperature set point; and the plurality of source elements is arranged such that one of the plurality of source elements configured to produce the highest-grade fluid, from among the plurality of source elements, is positioned closest to the decoupler conduit.

5. The system of claim 4, wherein the second load is configured to receive a grade of fluid that is higher than the grade of fluid the first load is configured to receive.

6. The system of claim 3, wherein each of the plurality of source elements has a respective temperature set point, and wherein the plurality of source elements is arranged such that a source element configured to produce the lowest-grade fluid, from among the plurality of source elements, is positioned closest to the first load.

* * * * *